US005651628A

United States Patent [19]

Bankes et al.

[11] Patent Number: 5,651,628

[45] Date of Patent: Jul. 29, 1997

[54] LOOSE-LEAF BINDER AND METHOD AND APPARATUS FOR MANUFACTURING IMPROVED LOOSE-LEAF BINDERS

[75] Inventors: James Robert Bankes, Ft. Worth; Robert Lee Montgomery, Red Oak, both of Tex.

[73] Assignee: Samsill Corporation, Fort Worth, Tex.

[21] Appl. No.: 547,738

[22] Filed: Oct. 26, 1995

Related U.S. Application Data

[63] Continuation of Ser. No. 100,099, Jul. 30, 1993, abandoned.

[51] Int. Cl.[6] ..... B42C 7/00; B42F 13/00

[52] U.S. Cl. ..... 402/73; 402/70; 281/29

[58] Field of Search ..... 412/1, 3, 902, 412/42; 281/37, 36, 29; 402/36, 70, 73

[56] References Cited

U.S. PATENT DOCUMENTS

| | | | |
|---|---|---|---|
| 790,762 | 5/1905 | Templeton . | |
| 793,370 | 6/1905 | Gresham . | |
| 1,565,630 | 12/1925 | Egerton | 283/36 X |
| 1,887,530 | 11/1932 | Trussell | 281/37 X |
| 1,905,093 | 4/1933 | Hazel et al. | 281/37 |
| 2,015,306 | 9/1935 | Gronauer | 281/37 |
| 2,078,988 | 5/1937 | Amato . | |
| 2,363,355 | 11/1944 | Pitt | 281/37 |
| 2,542,165 | 2/1951 | Taylor | 402/75 X |
| 3,263,687 | 8/1966 | Weichert . | |
| 4,138,143 | 2/1979 | Lawes | 281/23 X |
| 4,243,459 | 1/1981 | Lawes | 281/31 X |
| 4,552,478 | 11/1985 | Cohen . | |
| 4,795,194 | 1/1989 | Etheredge | 462/6 X |
| 5,213,368 | 5/1993 | Wyant | 281/36 X |

FOREIGN PATENT DOCUMENTS

| | | | |
|---|---|---|---|
| 464744 | 5/1950 | Canada | 281/37 |
| 46819 | 9/1939 | France | 402/79 |
| 956175 | 1/1950 | France | 281/37 |
| 1525272 | 5/1968 | France | 281/36 |
| 52899 | 3/1967 | Luxembourg | B42F 13/00 |
| 861105 | 2/1961 | United Kingdom | B42C 7/00 |
| 1010259 | 11/1965 | United Kingdom | B42F 13/26 |
| 1156906 | 7/1969 | United Kingdom | B42F 13/00 |

*Primary Examiner*—Frances Han
*Attorney, Agent, or Firm*—Melvin A. Hunn

[57] ABSTRACT

Disclosed is (1) a method of manufacturing a binder product, (2) an apparatus for use in operations for manufacturing binder products, (3) an improved binder which utilizes a rigid and arcuate spine board, and (4) an improved binder product with lid boards which are of a size in the range of industry standard sizes, but which are capable of fully enclosing tabbed document archiving office products.

13 Claims, 16 Drawing Sheets

LOOSE-LEAF BINDER AND METHOD AND APPARATUS FOR MANUFACTURING IMPROVED LOOSE-LEAF BINDERS

This is a continuation, of application Ser. No. 08/100, 099, filed Jul. 30, 1993 now abandoned.

BACKGROUND OF THE INVENTION

1. Field of the Invention

The present invention relates in general to office products and in particular to loose-leaf binders and an associated method and apparatus for manufacturing improved loose-leaf binders.

2. Description of the Prior Art

With the introduction of computerized word processing equipment into the work place, many experts predicted that office environments would soon be "paperless", with all "documents" being stored in computer memory instead of being printed and stored in a more conventional manner in files and filing cabinets. However, this prediction has failed to materialize. The introduction of computerized word processing equipment into the office place has resulted in a colossal increase in the amount of paper being generated.

One unforeseen result of the utilization of computer-generated word processing equipment in the office has been the introduction of a variety of type faces, some of which are quite crowded. Storing any document, but especially those documents containing a large amount of fine print, by conventional means would result in the punching of holes into the document which impairs the completeness and integrity of the document. Under modern office practices, such a destruction or degradation of an original document is becoming viewed as being unacceptable. Consequently, many entities which keep and store large volumes of original documents have turned to a variety of commercially available document archiving office products which simultaneously preserve original documents in an unmodified form, while allowing the documents to be maintained and arranged in an orderly fashion which facilitates later retrieval and use of the document. Experience has revealed that the kinds of document archiving office products which are most effective are those which include tabs along the right hand edge in order to facilitate the utilization of an organization scheme for the documents. Alternatively, and more commonly, document archiving office products can be utilized in combination with tabbed index sheets, and thus need not necessarily carry their own tabs.

The present invention is directed to an improved method of manufacturing binders, an apparatus which may be utilized during operations for manufacturing binders, and the improved binders themselves, all of which facilitate the utilization of document archiving office products, and in particular tabbed document archiving office products.

SUMMARY OF THE INVENTION

It is one objective of the present invention to provide a method of manufacturing a loose-leaf binder, which generally includes the following steps. A plurality of flexible and bondable sheets are provided, including a cover sheet and a liner sheet. A plurality of rigid and planar lid boards are provided. At least one rigid and arcuate spine board is provided. A loose-leaf ring binder mechanism is also provided. The plurality of rigid and planar lid boards, and the rigid and arcuate spine board are positioned into selected positions intermediate the cover sheet and the liner sheet. A bonding energy is applied to at least the cover sheet and the liner sheet in regions peripheral to (1) the plurality of rigid and planar lid boards, and (2) the rigid and arcuate spine board, causing the cover sheet to bond to the liner sheet in those regions. Finally, a loose-leaf binder ring is secured to a selected one of the rigid and planar lid boards.

It is another objective of the present invention to provide an apparatus for use in assembly line operations for manufacturing loose-leaf binders. The apparatus includes a set-up plate and a press plate. The set-up plate includes first and second planar regions for receiving a plurality of rigid and planar lid boards, and an arcuate region for receiving a rigid and arcuate spine board. The plurality of rigid and planar lid boards and the rigid and arcuate spine board are disposed intermediate a flexible and bondable cover sheet and a flexible and bondable liner sheet. The press plate includes opposing first and second planar regions for selective pressing engagement with the first and second planar regions of the set-up plate. The press plate also includes an opposing arcuate region for selective pressing engagement with the arcuate region of the set-up plate. The apparatus also includes a source of bonding energy, and a means for preferentially directing the bonding energy between the set-up plate and the press plate only in regions of the flexible and bondable sheet and the flexible and bondable liner sheet which are peripheral to (1) the plurality of rigid and planar lid boards, and (2) the rigid and arcuate spine board.

It is another objective of the present invention to provide a binder product which is composed of a number of components. The binder includes a planar front lid board, and a planar back lid board, as well as a rigid and arcuate spine board positioned intermediate the planar front lid board and the planar back lid board. The planar front and back lid boards and the rigid and arcuate spine boards am positioned intermediate a flexible and bondable cover sheet and a flexible and bondable liner sheet. The flexible and bondable cover sheet and the flexible and bondable liner sheet are bonded together at portions peripheral to the planar front and back lid boards and the rigid and arcuate spine board. A fastener mechanism is coupled to the planar back lid board adjacent the rigid and arcuate spine. board. The fastener mechanism includes a plurality of separable ring members which are spaced apart. Each of the plurality of separable ring members includes an arcuate ring portion adjacent the rigid and arcuate spine board with a curvature generally corresponding to that of the rigid and arcuate spine board.

A still more particular objective of the present invention is to provide a binder product which is composed of a plurality of components which have certain operating features. The binder includes planar front and back lid boards, with the front and back lid boards having a width which is within a range of industry-standard widths for lid boards. The binder also includes a rigid and arcuate spine board, which has a preselected radius of curvature, which is positioned intermediate the planar front lid board and the planar back lid board. The planar front and back lid boards and the rigid and arcuate spine board are positioned intermediate a flexible and bondable cover sheet and a flexible and bondable liner sheet. The flexible and bondable cover and liner sheets are bonded together at portions which are peripheral to the planar front and back lid boards and the rigid and arcuate spine board. The binder also includes a fastener mechanism which is coupled to the planar back lid board adjacent a convex side of the rigid and arcuate spine board. The binder is operable in a plurality of conditions including an open condition and a closed condition. In the open condition, the binder is in a position suitable for receiving a plurality of documents and office products, including tabbed document archiving office products capable of non-destructive retention of standard sized documents. In the closed condition, the binder is suited for storing the plurality of documents and office products, and is particularly suited for storing documents and office products on standard-sized binder shelves. During the closed condition, the tabbed document archiving office products are maintained entirely between the planar front lid board and the planar back lid board, thus protecting from damage the tab portions of these tabbed document archiving office products, and allowing the binder to be stored in industry-standard storage shelves.

In an alternative embodiment, flexible and planar front and back lid boards may be substituted in place of the rigid and planar front and back lid boards, to provide a binder which has front and back covers which are somewhat more flexible than a standard loose-leaf binder. In this embodiment, a rigid and arcuate spine board is placed intermediate the flexible and planar lid boards, and all of these components are sandwiched between a flexible cover sheet and a flexible liner sheet. Typically, in this type of "soft" product the cover sheet and liner sheet are secured together by sewing rather than through the utilization of radio-frequency bonding equipment. This provides a "richer" look for the product, which is generally sold at higher prices than standard loose-leaf binders.

Additional objectives, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

FIG. 3*c* provides a perspective view comparison of a prior art D-ring binder with the improved D-ring binder of the present invention, each in a closed condition and with a plurality of tabbed office products contained therein;

DETAILED DESCRIPTION OF THE INVENTION

Figure 1A:
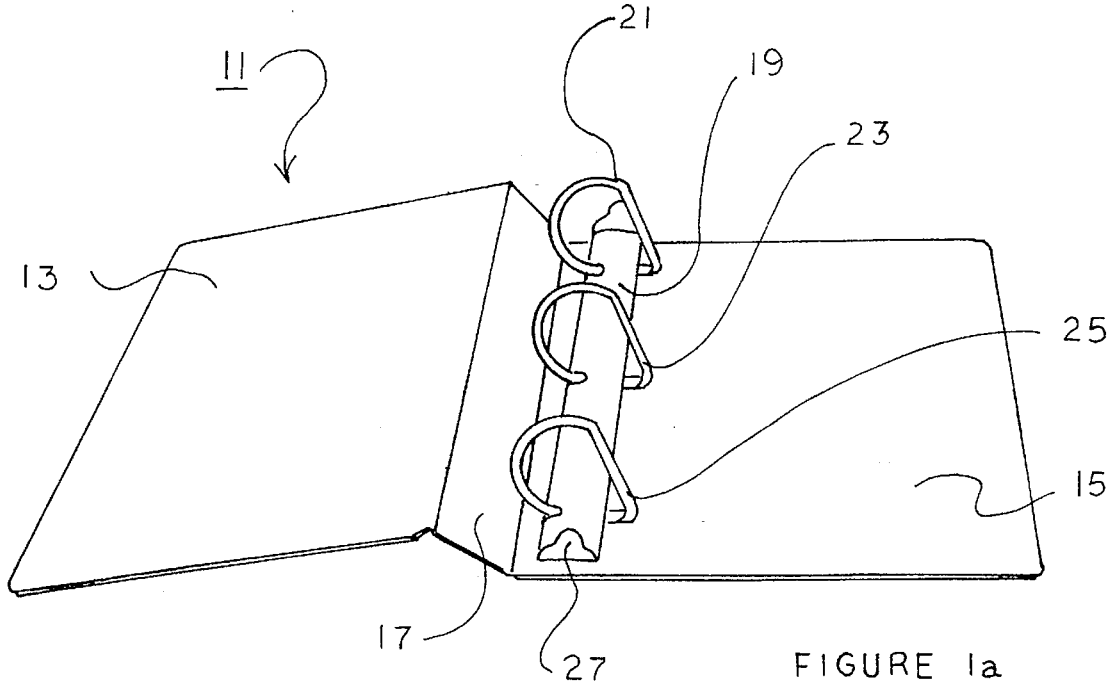
FIGURE 1a PRIOR ART
FIG. 1*a* and 1*b* are perspective views of a prior art D-ring binder in open and closed conditions respectively.
Figure 1B:
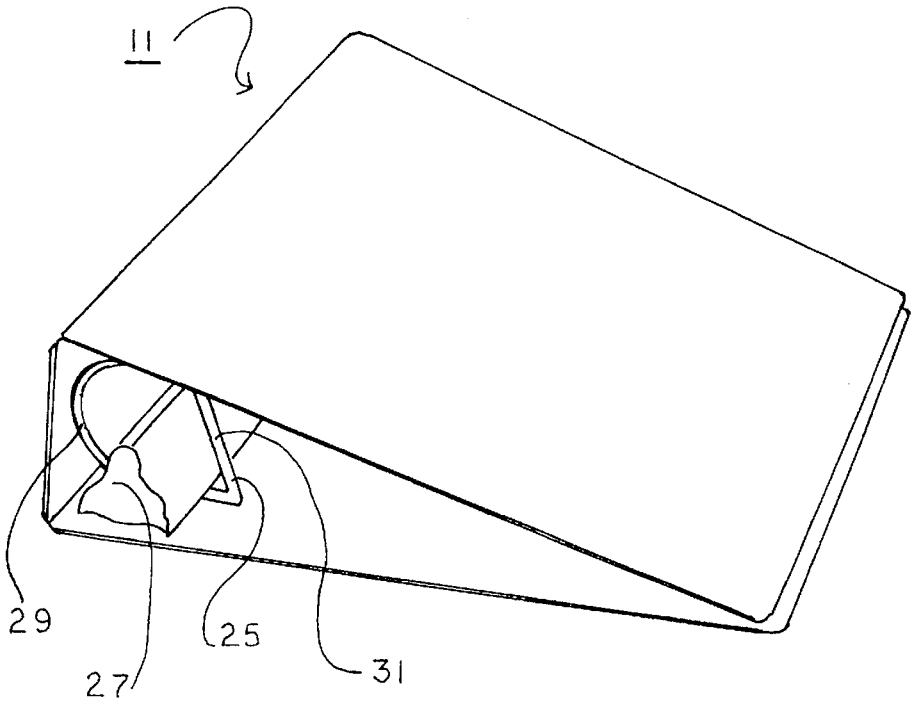
FIGURE 1b PRIOR ART
Figure 1C:
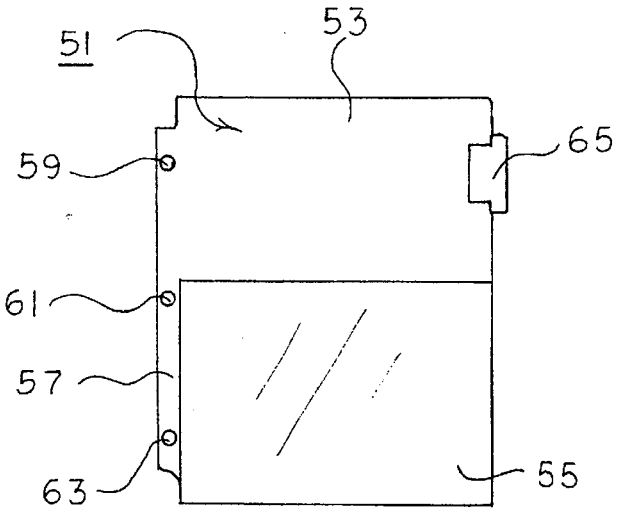
FIGURE 1c PRIOR ART
FIG. 1*c* through 1*g* are top views of a plurality of prior art tabbed office products which are utilized in binders to organize and archive documents and mass memory devices for computers.
Figure 1D:
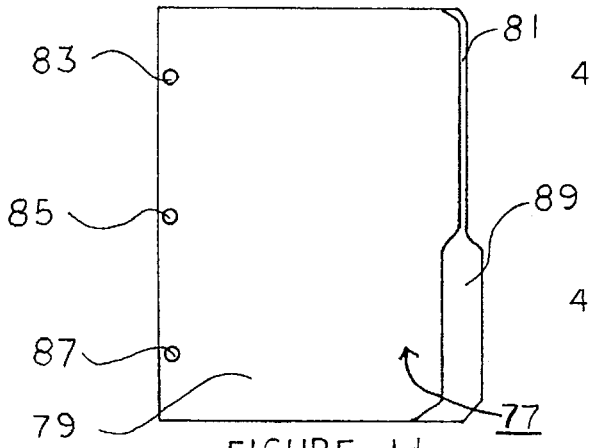
FIGURE 1d PRIOR ART
Figure 1E:
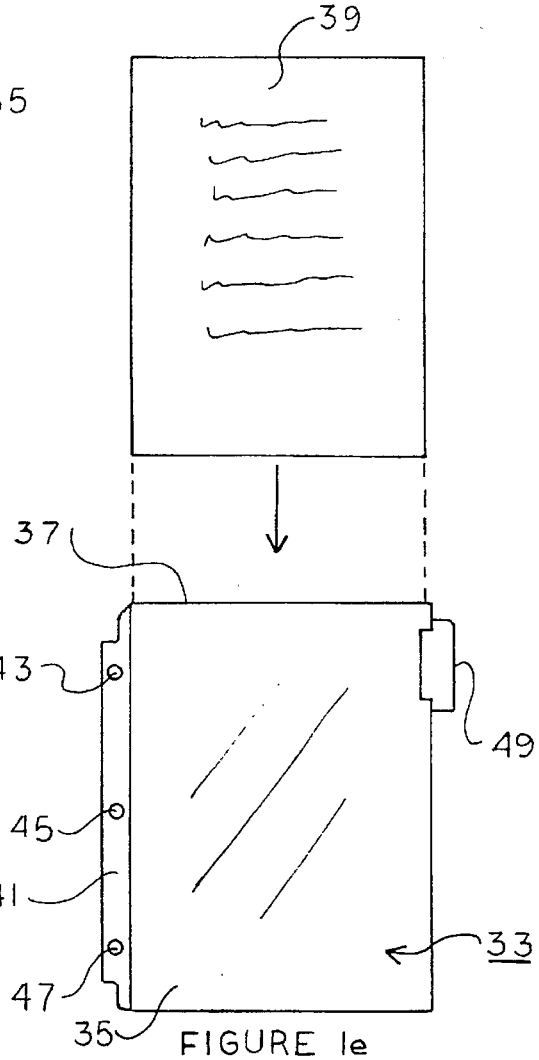
FIGURE 1e PRIOR ART

FIG. 1*a* and 1*b* are perspective views of a prior art D-ring binder 11 in open and closed conditions. As is shown, D-ring binder 11 includes front lid board 13, back lid board 15, spine board 17, and a D-ring fastener mechanism 19 secured to back lid board 15 by rivets. As is conventional, the front lid board 13, back lid board 15, and spine board 17 are composed of cardboard panels (referred to in the industry as "chipboards") which are covered by non-expanded film vinyl. More specifically, the cardboard inserts are positioned between a flexible and bondable cover sheet of non-expanded film vinyl and a flexible and bondable liner sheet of non-expanded film vinyl. The vinyl is bonded together using a conventional radio-frequency heat technology, which will be discussed in further detail herebelow.

The D-ring fastener mechanism 19 includes three spaced apart ring members 21, 23, 25. Each ring member 21, 23, 25 includes an arcuate ring portion and a slanted ring portion, which are separable by operation of trigger 27, which thus allows the positioning of documents and other items within the D-ring binder 11.

FIG. 1*a* depicts D-ring binder 11 in an open condition. FIG. 1*b* depicts D-ring binder 11 in a closed condition. As is shown in FIG. 1*b*, arcuate portion 29 of ring member 25 touches the inner surface of spine board 17 when D-ring binder 11 is closed.

It has become increasingly more common for offices to utilize tabbed document archiving office products, which are capable of non-destructive retention of standard-sized documents, as inserts in binders to archive and arrange documents while maintaining the documents in the best condition possible. These documents archiving office products do not require that holes be punched into the document in order to secure into position within the binder. Instead, the document archiving office products are designed to carry their own means for coupling into a selected position within a particular binder. FIG. 1*c* through 1*g* are top views of a plurality of such prior art document archiving office products, each of which is capable of non-destructive retention of standard-sized documents. Foremost among the document archiving office products is top-loading sheet protector 33, which includes a transparent pocket 35 defined by front and back sheets (both of which are transparent), with an opening 37 along its top portion which allows for the insertion and removal of document 39 from transparent pocket 35. Top loading sheet protector 33 further includes, at its left-most portion, a fastener segment which includes holes 43, 45, 47, which are adapted for receiving ring members 21, 23, 25 of D-ring binder 11 of FIG. 1*a* and 1*b*. Top loading sheet protector 33 further includes tab 49 along its right-hand portion. Tab 49 may define a transparent envelope for receipt of printed labels, or alternatively may include a surface which is suitable for receiving handwritten or typed text, or alternatively may be suitable for receiving adhesive labels. In any event, tab 49 receives a human-readable textual portion which allows top-loading sheet protector 33 to be easily identified within a D-ring binder 11, and to be arranged relative to other items within the binder. Alternatively, document archiving office products may be utilized in combination with tabbed index sheets, and thus need not carry their own tabs. For purposes of this application, the term "tabbed document archiving office product" is intended to comprehend products which carry their own tabs and products which are utilized with tabbed index sheets to provide "tabbing" orientation.

Typically, document 39 is a sheet which is eleven inches long by eight and one-half inches wide (11"×8½") Accordingly, top loading sheet protector 33 is eleven inches long but exceeds eight and one-half inches in width, usually by one-half inch. Typically, tab 49 extends an additional one-half inch along the right-most edge. Therefore, a typical top loading sheet protector 33 is eleven inches long by nine and one-half inches wide (11"×9½").

Viewed broadly, a top-loading sheet protector, and other document archiving office products, has certain dimension requirements which are established by the dimensions of a societal or industry standard for paper. In Europe, a different "standard size" exists for letters, namely 8.27 inches×11.69 inches, which is known as "A-4" size. In the United States of America, some portion of the legal profession and certain courts utilize "legal size" paper which has the dimensions of fourteen inches long by eight and one-half inches wide; such a paper may be considered to be a "standard size" paper for portions of that profession. The dimension requirements of the document archiving office products is thus generally established with regard to the particular "standard-sized" document which is to be archived. Generally speaking, the fastener segment for receiving the rings of the binder and the tab which is utilized to maintain order will require an additional inch, more or less, of width for the document archiving office product. Thus, tabbed document archiving office products will usually have a width which is generally one inch more than that of a document being archived.

FIG. 1*c* through 1*g* depict other types of document archiving office products. Binder pocket 51 includes back sheet 53 which is, for the United States of America letter size standard, a full eight and one-half inches wide by eleven inches long, and front sheet 55 which is eight and one half inches wide by five or six inches long. Front and back sheets 53, 55 may be formed of a transparent plastic material, or of a paper stock which is not transparent, or of any combination. Binder pocket 51 further includes a fastener segment 57 with holes 59, 61, 63, located at the left-most edge, and tab portion 65 located at the right-most edge.

Divider 67 may also be utilized in a ring binder. Typically, divider 67 is integrally formed from a rigid and planar substance, such as cardboard or a stiff paper, although plastic dividers are also used. Divider 67 includes holes 69, 71, 73 for receipt of the rings of a ring binder, and tab 75 for receipt of printed material identifying or orienting documents within the binder. Divider 67 is typically used to separate documents from one another to minimize the possibility of erroneous removal or grouping of documents which are not related. Dividers 67 can also be utilized to provide orientation within a ring binder based upon subject matter, date, numerical order, or alphabetical order.

File folder 77 can also be utilized in document archiving operations. Typically, file folder 77 is formed of a stiff paper, and includes front cover 79 and back cover 81. Holes 83, 85, 87 are provided through both front cover 79 and back cover 81. Tab portion 89 is also provided for receiving printed or other identifying material which identifies the document specifically, or provides general information about the documents contained between the front cover 79 and back cover 81. This is one excellent mechanism for organizing documents or other document archiving office products such as top loading sheet protector 33 or binder pocket 51.

With the increased reliance upon computer-operated word processing equipment, mass memory devices for computers can replace or supplement paper records, but the mass storage devices, such as floppy disks, must be organized in the same way that paper documents must be organized. Accordingly, an increasing number of document archiving office products are being made available which allow for the organization and storage of mass memory for computer-generated word processing equipment.

Figure 1F:
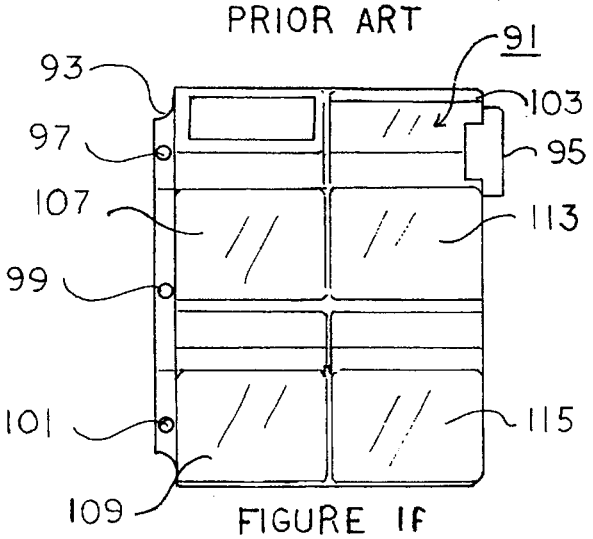
FIGURE 1f PRIOR ART
Figure 1G:
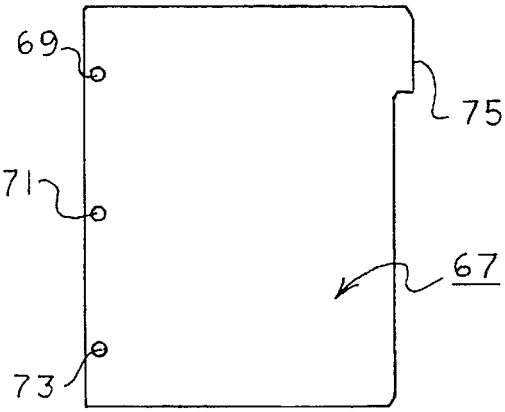
FIGURE 1g PRIOR ART

FIG. 1*f* provides an example of one such product: computer disk holder 91, with a fastener segment 93 at its left-most side with holes 97, 99, 101, and tab 95 on the right-most side. Computer disk holder 91 typically includes a vinyl or flexible back sheet 103, and a plurality of vinyl front segments 107, 109, 113, and 115, which define pockets for the receipt of diskettes which serve as mass memory for computer operated word processing equipment. Typically, back sheet 103 will be eleven inches long by nine inches wide, with fastener segment 93 and tab 95 adding an additional one inch of width to computer disk holder 91.

Figure 1H:
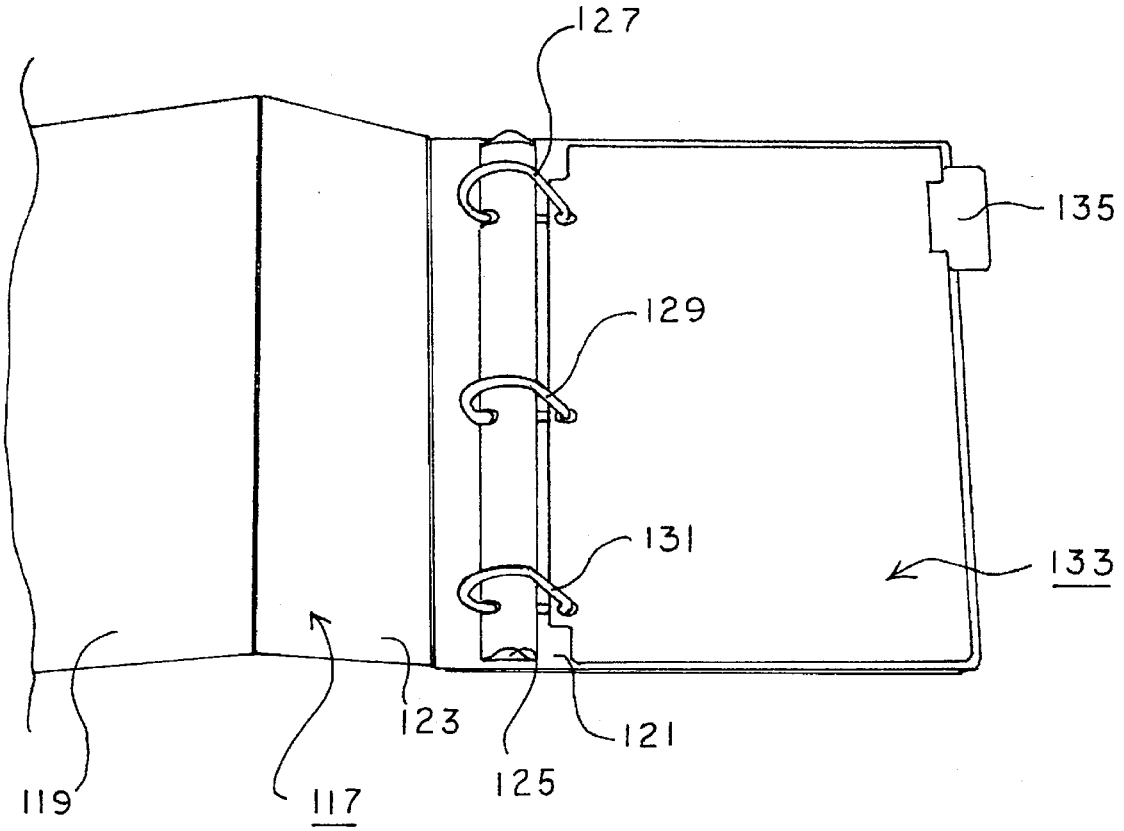
FIGURE 1h PRIOR ART
FIGS. 1*h* through 1*l* graphically depict problems encountered during use of the prior art D-ring binders with the prior art tabbed office products of FIG. 1*c*.

FIG. 1*h* depicts one problem of utilizing tabbed document archiving office products, such as those illustrated, with a prior art "standard" sized loose-leaf binder 117, which is constructed in accordance with the industry standards. As is shown, loose-leaf binder 117 includes front cover 119, back cover 121, spine 123, fastener 125 which includes binder ring members 127, 129, 131. As is shown, a tabbed document archiving office product 133 is secured in position within loose-leaf binder 117. Note that tab 135 extends beyond back cover 121. The industry has developed an "extended" sized loose-leaf binder which fully encloses the tab portions of document archiving office products.

As is conventional in the industry, the front and back covers of binders capable of storing "letter" (11 inches long by 8½ inches wide) standard size documents is as follows:

(1) for a loose-leaf binder having a paper capacity of one inch, a <u>standard</u> D-ring binder has a lid board width of ten and three sixteenth inches (10 3/16");

(2) for a loose-leaf D-ring binder having a paper capacity of one inch, an <u>extended</u> D-ring binder has an extended-size lid board width of eleven inches;

(3) for a loose-leaf D-ring binder having a paper capacity of one and one half inches, a <u>standard</u> D-ring binder has a lid board width of ten and seven-eighths inches (10⅞");

(4) for a loose-leaf D-ring binder having a paper capacity of two inches, a <u>standard</u> D-ring binder has a lid board width of eleven and one-quarter inches (11¼");

(5) for a loose-leaf D-ring binder having a paper capacity of two inches, an <u>extended</u> D-ring binder has an extended lid board width of twelve and one-quarter inches (12¼");

(6) for a loose-leaf D-ring binder having a paper capacity of three inches, a standard D-ring binder has a lid board width of twelve and one-eighth inches (12⅛");

(7) for a loose-leaf D-ring binder having a capacity of three inches, an extended D-ring binder has an extended lid board width of twelve and one-half inches (12½"), and will not close all the way due to contact between the binder lid boards and the binding mechanism.

Figure 1I:
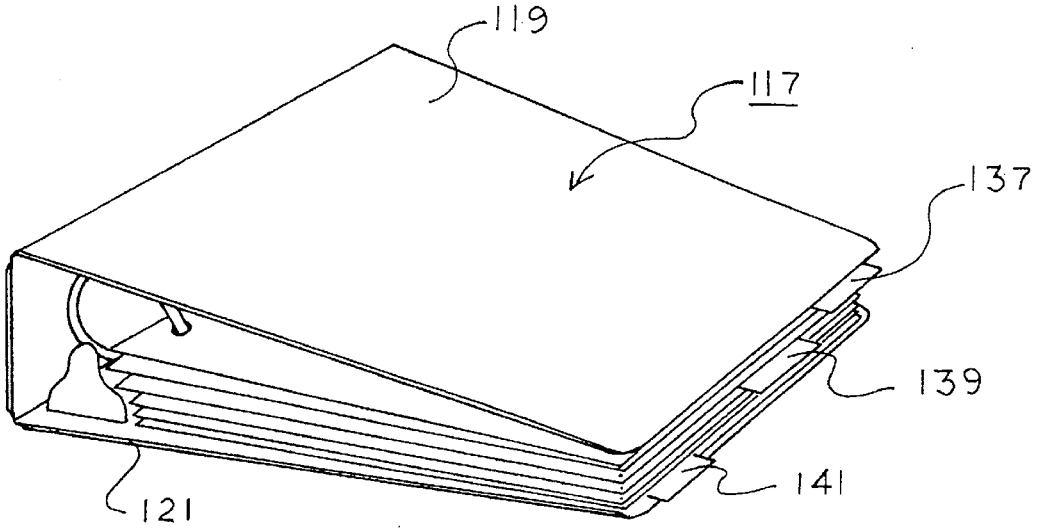
FIGURE 1i PRIOR ART
Figure 1J:
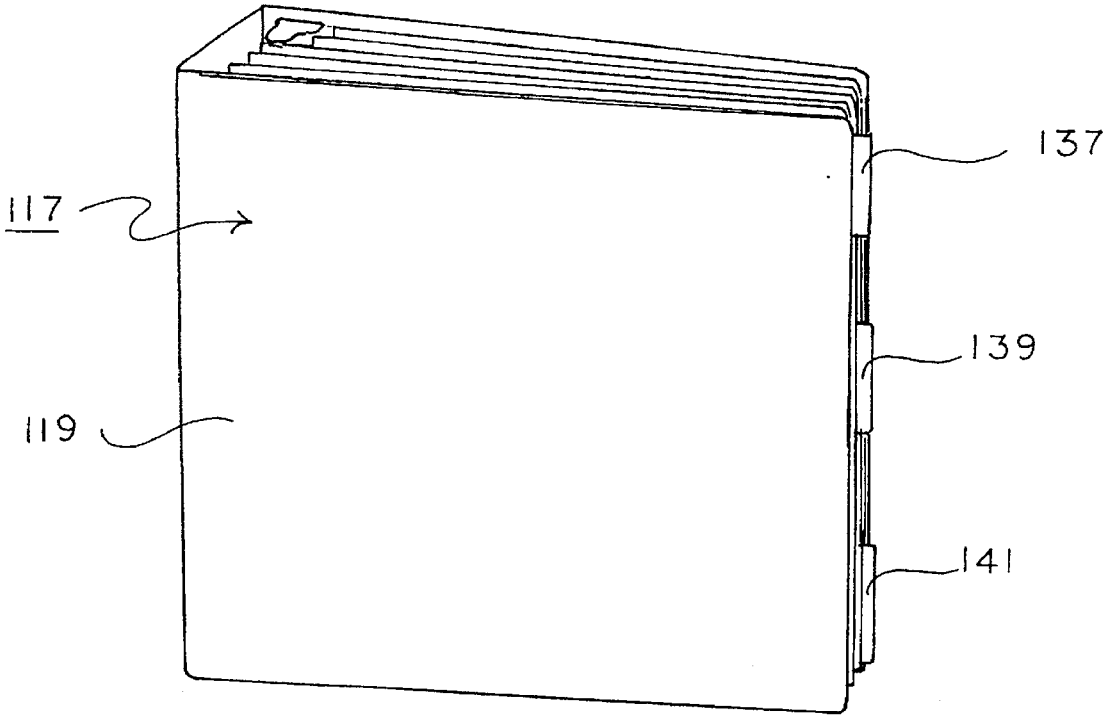
FIGURE 1j PRIOR ART
Figure 1K:
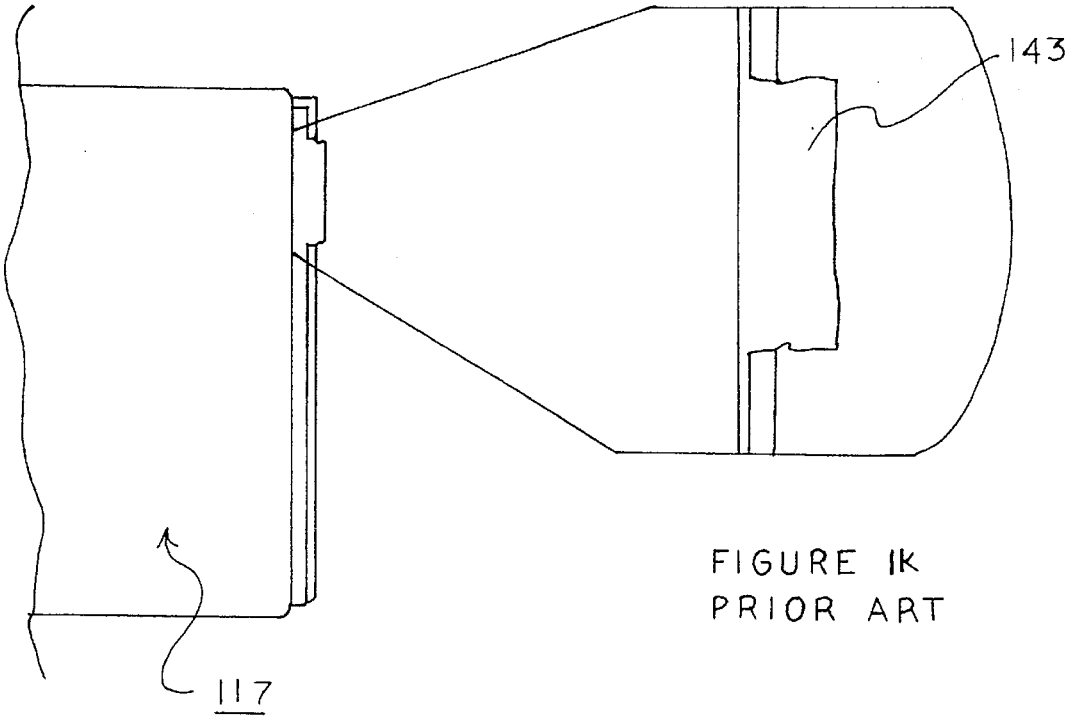
FIGURE 1K PRIOR ART

As can be seen in FIG. 1*h*, tab portion 135 of tabbed document archiving office product 133 extends beyond the outer edge of back cover 121. This causes considerable problems which will be discussed with reference to FIG. 1*i*, 1*j* and 1*k*. FIG. 1*i* depicts prior art loose leaf binder 117 of FIG. 1*h* with the plurality of tabs document archiving office products disposed therein. As can be seen, tab portions 137, 139, 141 extend beyond both the front and back covers 119, 121. FIG. 1*j* provides a different view of the binder than that of FIG. 1*e*, and clearly depicts that tabbed portions 137, 139, 141 extend, substantially entirely, outward of loose leaf binder 117, and are thus unprotected. It is common for binders which include tabbed document archiving office products to be used for lengthy periods of time. The binders may be carried about by workers during their work day, or packed into briefcases for travel. Because tabbed portions 137, 139, 141 of loose leaf binder 117 extend beyond the front and back covers 119, 121, it is highly probably that they become damaged during normal use. Such damage is depicted in FIG. 1*k*, wherein tabbed portion 143, which contains important and useful human readable text thereon, is damaged, and in an unreadable condition. This is a serious problem, since the tab portions are so useful in identifying and organizing original documents. Utilization of prior art binders will necessitate the eventual replacement of the tabbed document archiving office products, which may be labor intensive and thus expensive.

Figure 1L:
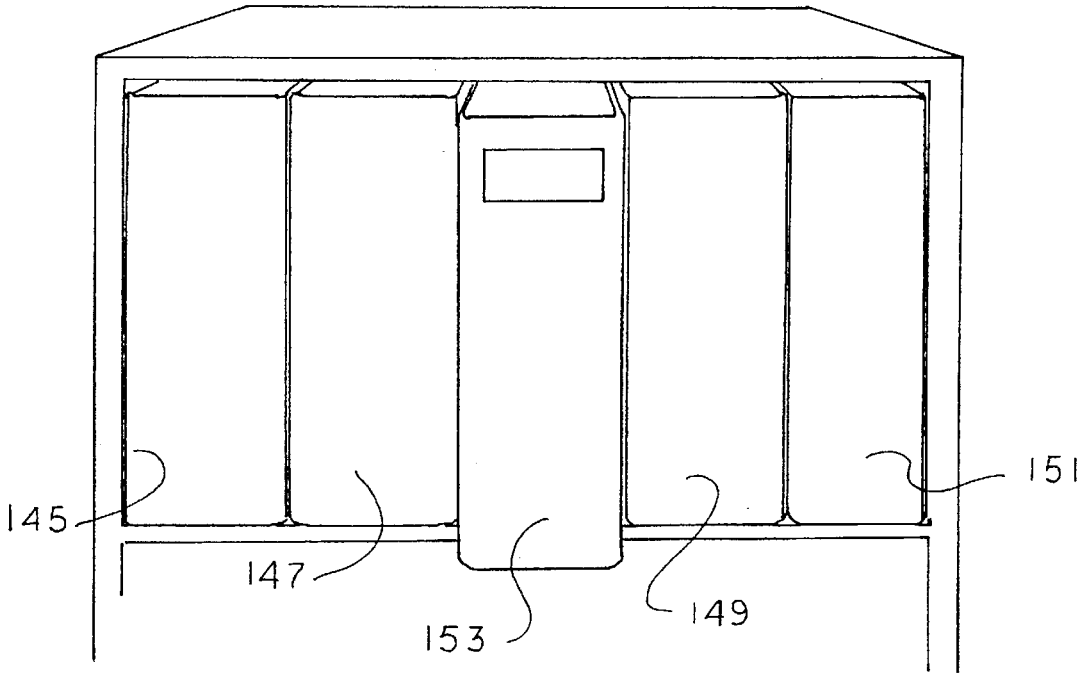
FIGURE 1l PRIOR ART

FIG. 1*l* depicts still another problem with the prior art binders, which are of the "extended" size. Since industry standards have developed concerning binder width for "standard" sized binders, many office furniture manufacturers have adopted a standard for shelf depth for the storage of binders. Unfortunately, the industry-standard does not accommodate the wider "extended" size binders. If prior art binders are utilized in conjunction with tabbed document archiving office products, the office worker has two choices: (1) utilize the "standard" sized binders, and accept the risk of eventual damage to the tab portions of the binders, or (2) utilize an "extended" sized binder which does not fit well within standard sized storage shelves for binders. In FIG. 1*l*, standard sized binders 145, 147, 149, and 151 are shown pushed fully in, perhaps to the detriment of the tabbed portions of the tabbed document archiving office products contained therein, while extended size binder 153 is shown jutting-out slightly from the shelf. Either option is undesirable. If the binder is not fully in the shelf it is exposed to dust, humidity, and possible displacement from the shelf during normal office operations. Either the tabbed portions are certainly jeopardized, or the binder in its entirety is possibly jeopardized.

Figure 2A:
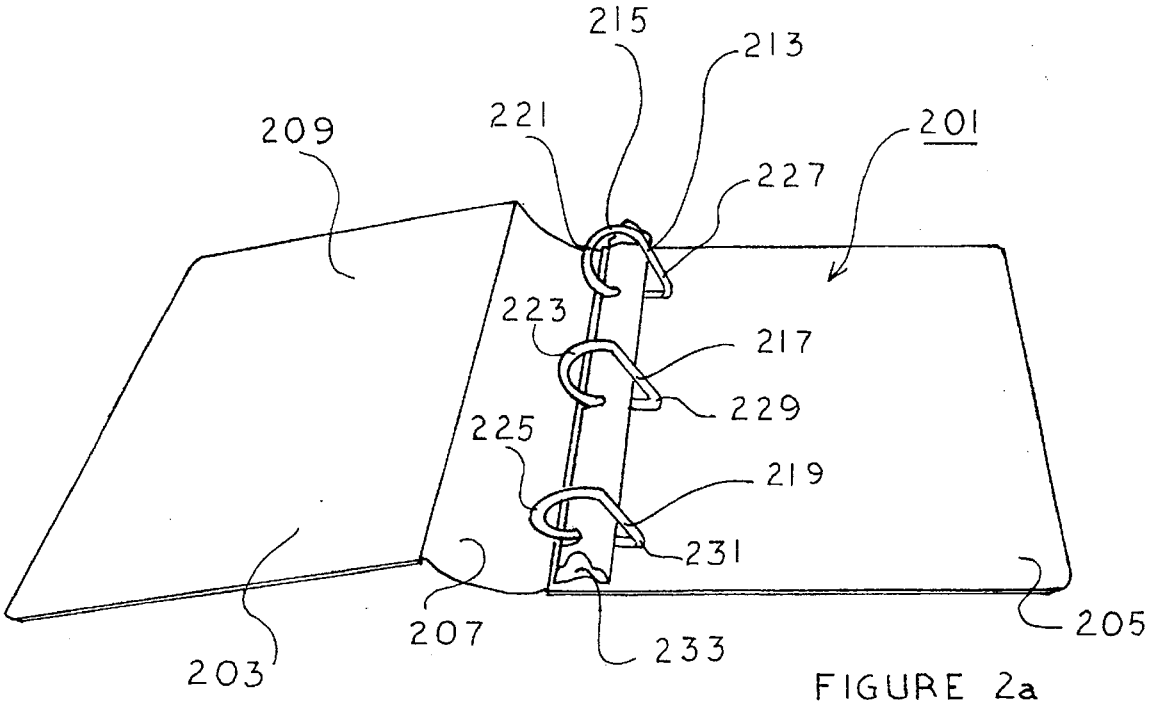
FIGS. 2*a* and 2*b* are perspective views of the improved D-ring binder of the present invention in open and closed conditions respectively.
Figure 2B:
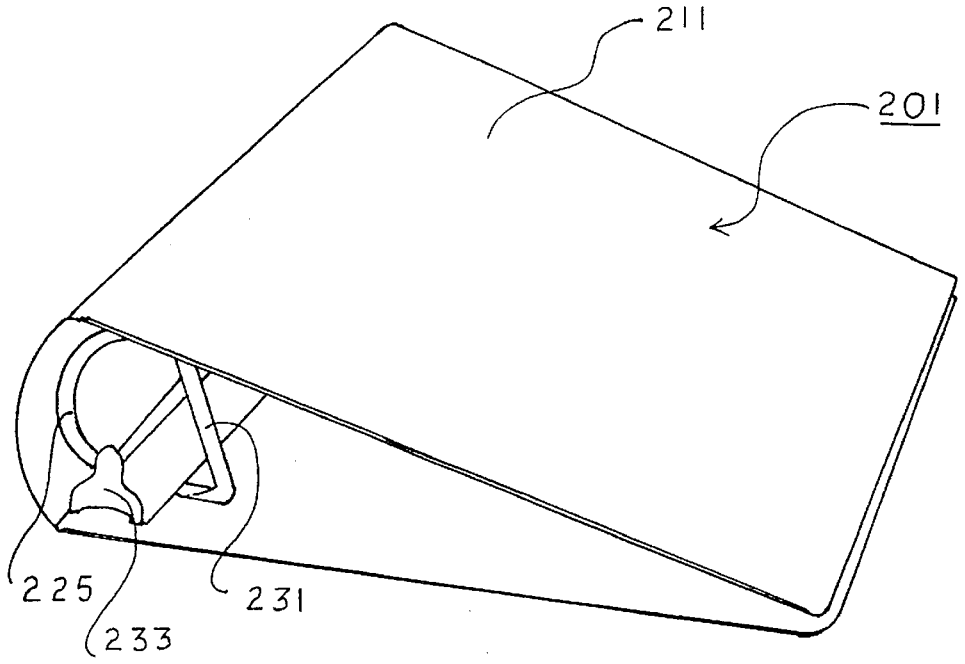

FIGS. 2*a* and 2*b* are perspective views of the improved D-ring binder of the present invention in open and closed conditions, respectively. As is shown in FIG. 2*a*, loose leaf binder 201 includes front cover 203, back cover 205, and rigid and arcuate spine board 207. In the preferred embodiment of the present invention, front cover 203 and back cover 205 include rigid and planar lid boards which are formed of a stiff paper or chipboard product which is planar and which maintains its rigidity. Also, in the preferred embodiment, rigid and arcuate spine board 207 includes a rigid and arcuate spine board member which is interposed between the lid board of front cover 203 and the lid board of back cover 205. Preferably, the lid boards and the arcuate spine boards are interposed between sheets of flexible and bondable material, such as non-expanded, or expanded, film vinyl. In FIG. 2, the inner (or "liner") sheet is shown. In FIG. 2*b*, the outer (or "cover") sheet is shown.

As is shown in FIG. 2*a*, loose leaf binder 201 further includes a conventional binder mechanism 213 which includes a plurality of separable ring members 215, 217, and 219, which are spaced apart a selected distance to accommodate conventional office products which include holes for placement in three ring binders.

The loose leaf binder 201 which is depicted in FIGS. 2*a* and 2*b* is a D-ring type loose leaf binder, with the separable ring members including arcuate portions 221, 223, 225 and slanted portions 227, 229, 231 which are biased together until latch 233 is actuated to cause their separation, which thus allows the placement of documents within loose leaf binder 201.

Figure 2C:
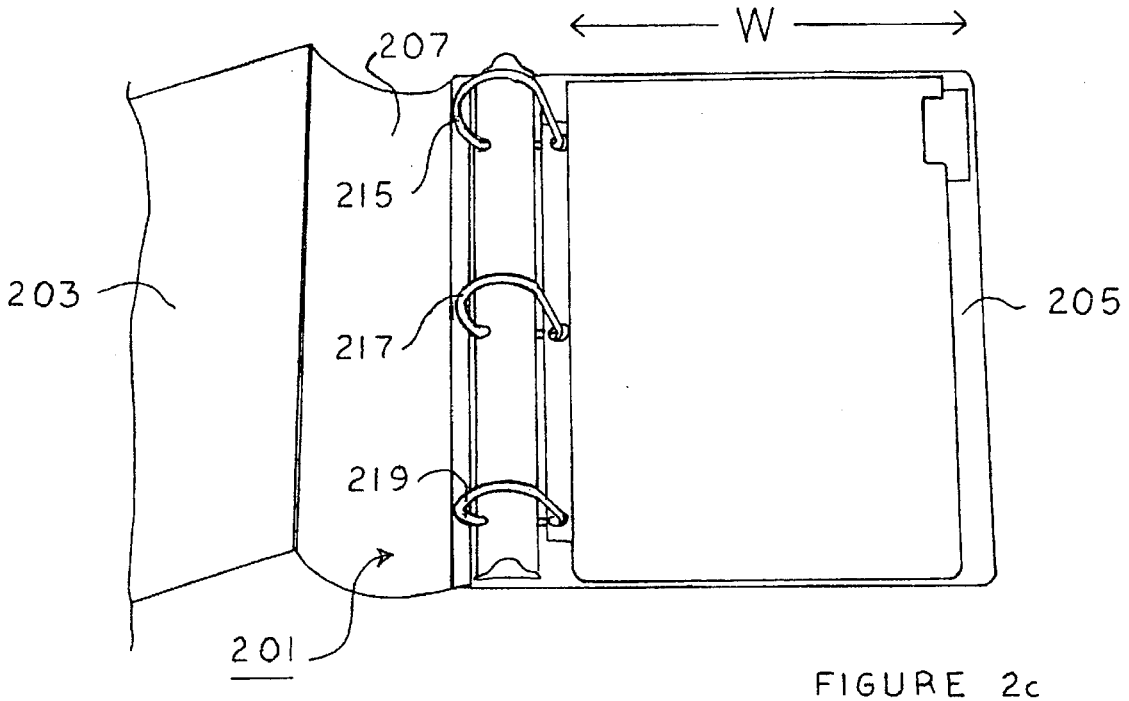
FIG. 2*c* is a top view of the improved D-ring binder of the present invention in an open condition with one prior art tabbed office product disposed therein.
Figure 2D:
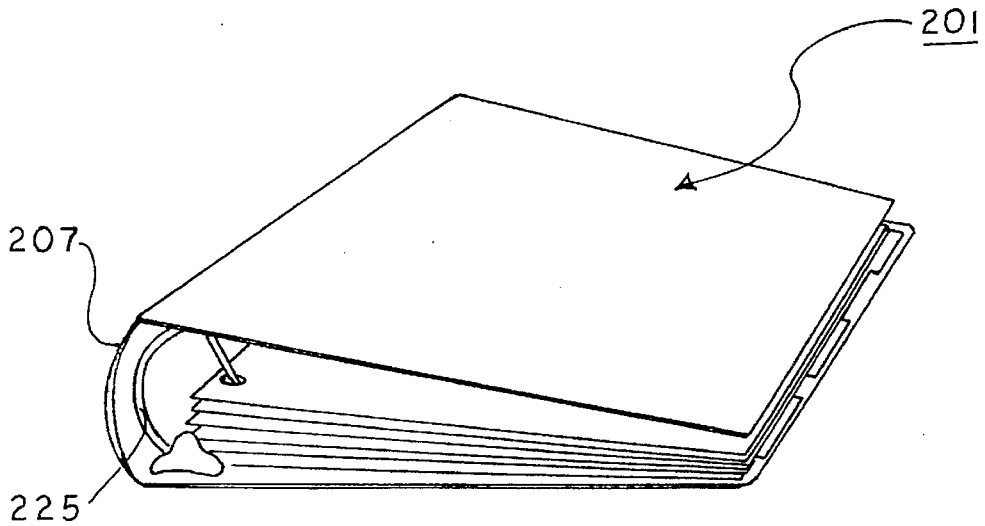
FIG. 2*d* is a perspective view of the improved D-ring binder of the present invention in a closed condition with a plurality of tabbed office products disposed therein.

FIGS. 2*c* and 2*d* depict loose leaf binder 201 in open and closed conditions with tabs document archiving office products contained therein. In the present invention, loose leaf binder 201 has a width which is within the range of industry standard widths for binders having comparable paper capacities. For a one inch capacity D-ring binder, the front and back covers of a binder in accordance with the present invention will have a width of ten and seven-eights inches (10⅞"). For a binder having a three inch paper capacity, a D-ring binder in accordance with the present invention will have front and back covers with a width of eleven and seven-eights inches (11⅞"). Thus, for a one inch capacity D-ring binder in accordance with the present invention, the width of the front and back covers is intermediate that of the two existing industry standard widths for standard D-ring binders and extended D-ring binders. For three inch paper capacity D-ring binders in accordance with the present invention, the front and back covers will have a width which is also intermediate that of the industry standard for a standard D-ring binder and an extended D-ring binder. The same will apply for binders constructed in accordance with the present invention which have different capacities, since the goal is to maintain the width of the front and back covers within the range of established industry standard ranges of widths in order to allow the binder to be stored on industry standard shelves having shelf depths which are adequate for maintaining prior art D-ring binders, but which would not be fully adequate for maintaining binders which have a width which exceeds the range of industry standard widths.

While the binders constructed in accordance with the present invention have a width which is within the range of industry standard binder widths, they nonetheless are capable of completely enclosing conventional tabbed document archiving office products, as is depicted in FIGS. 2*c* and 2*d*. This accomplishment is possible because of the utilization of rigid and arcuate spine board 207 which has a contour which generally conforms to that of the arcuate portion of the separable ring members 215, 217, 219, as is best depicted in FIG. 2*d*. This allows the fastener mechanism 213 to be positioned more closely to the spine member of the binder than is possible with prior art D-ring binders. In FIG. 1*b*, the contact between arcuate portion 209 of the ring and the spine of the binder is depicted. It is precisely this contact which requires that in a prior art binder the binding mechanism be placed some considerable distance back from the spine. In contrast, in the present invention, the arcuate portion of the fastener mechanism ring members is "nested" in the convex portion of the spine member in a manner which optimizes space within the binder. This optimization of the use of the space within the binder results in a binder which is capable of maintaining tabbed document archiving office products fully within the binder when the binder is in a closed condition, thus fully protecting the tabbed portions of the tabbed document archiving office products, without requiring that the front and back covers of the binder be oversized to be beyond the range of industry standard widths.

Figure 2E:
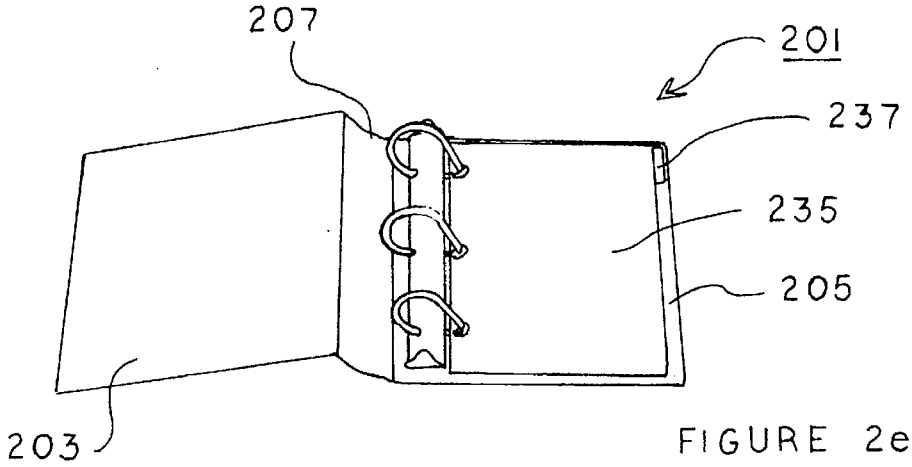
FIGS. 2*e*, 2*f*, and 2*g* graphically depict the operation of closing the improved D-ring binder of the present invention.
Figure 2F:
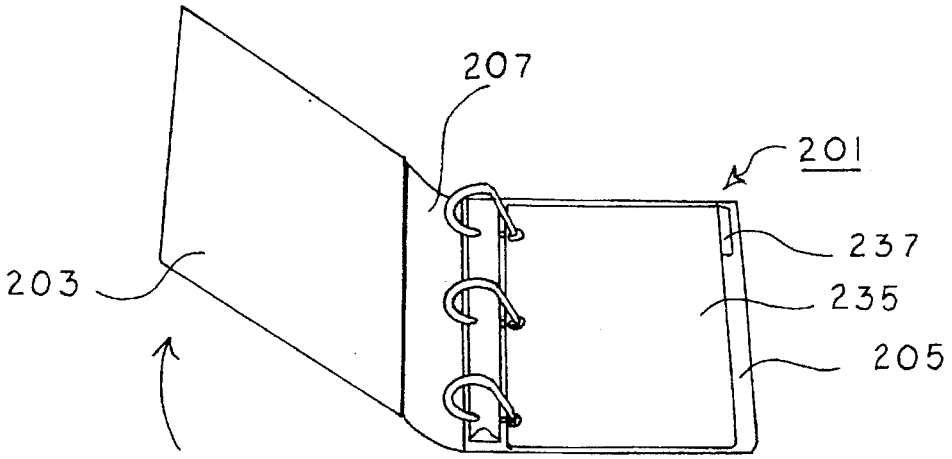
Figure 2G:
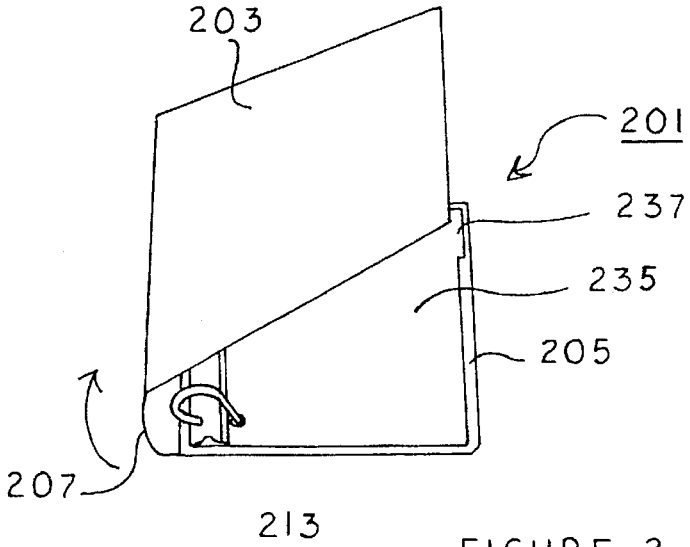

During all operating conditions, the tabbed document archiving office products remain protected within the confines established by the binder. This is graphically illustrated in FIGS. 2*e*, 2*f*, and 2*g*. In FIG. 2*e*, loose leaf binder 201 is in a fully open condition, with front cover 203 fully separated from back cover 205. Note that rigid and arcuate spine 207 completely maintains its shape while loose leaf binder 201 is in the open condition. Also note that tab portion 237 of tabbed document archiving office product 235 is maintained fully within the confines of back cover 205, and is thus protected from damage. FIG. 2*f* graphically depicts binder 201 in a partially open condition, with front cove 203 being rotated through an arc. Note that rigid and arcuate spine 207 maintains its shape. Also note that tab portion 237 of tabbed document archiving office product 235 is maintained fully within the confines of back cover 205, and is thus also protected from damage. FIG. 2*g* graphically depicts a partially closed condition with front cover 203 descending upon back cover 205 to close loose leaf binder 201. The arcuate portions of fastener member 213 become nested within the convex side of rigid and arcuate spine 207. Also note that tab portion 237 of tabbed document archiving office product 235 is maintained fully within the confines of back cover 205.

FIGS. 3*a* through 3*i* provide a variety of views of side-by-side comparison of a prior art loose leaf binder and a loose leaf binder constructed in accordance with the present invention.

Figure 3A:
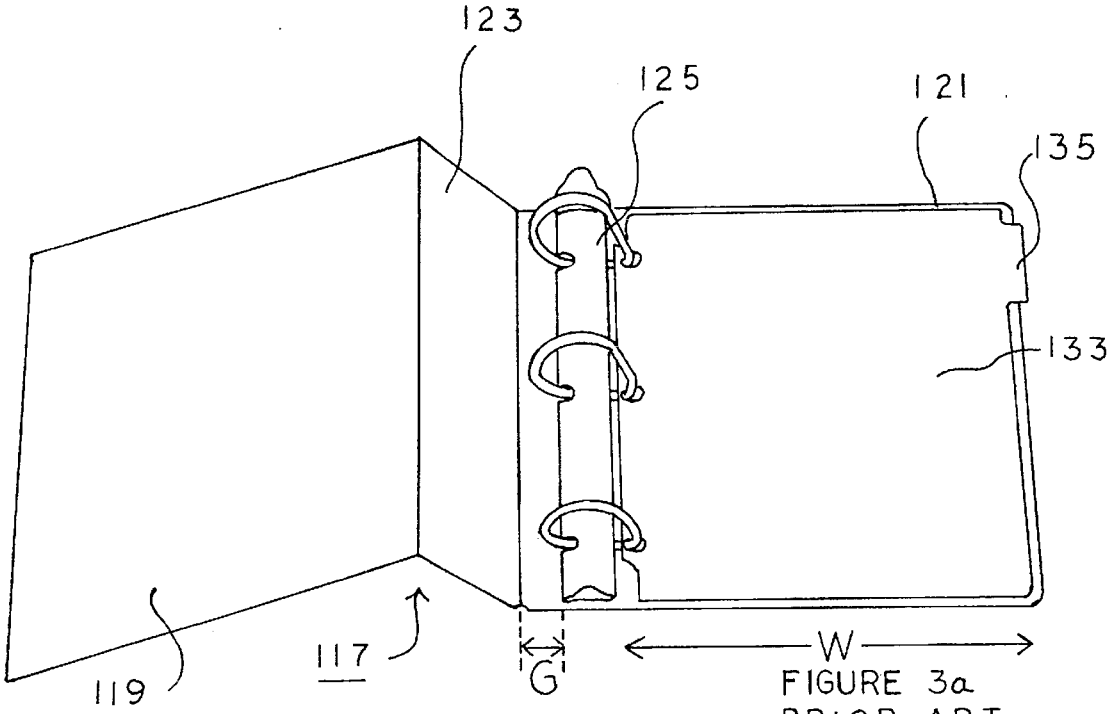
FIGURE 3a PRIOR ART
FIG. 3*a* and 3*b* provide top views comparison of a prior art D-ring binder with the improved D-ring binder of the present invention, each in an open condition with a tabbed office product disposed therein.
Figure 3B:
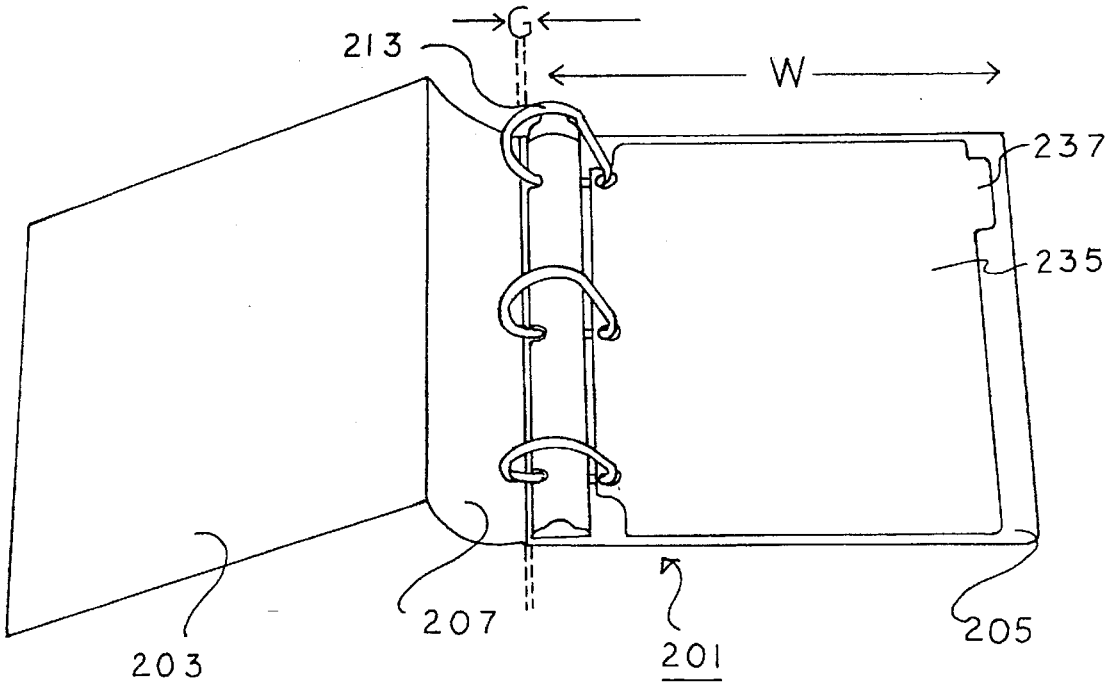

As is shown in FIGS. 3*a* and 3*b*, loose leaf binder 117 has binder mechanism 205 positioned a distance G from the connection to spine board 123. Front and back covers 119, 121 have a width W which is an industry standard width. However, tab portion 135 of tabbed document archiving office product 133 extends beyond the confines of back cover 121. In contrast, loose leaf binder 201 of the present invention has binder mechanism 213 positioned a distance G from the connection to rigid and arcuate spine board 207. Front and back covers 203, 205 have a width W which is within the range of industry standard widths; however, tab portion 237 of tabbed document archiving office product 235 is maintained fully within the confines of binder 201. In the prior art device, the distance G between fastener 125 and spine board 123 is typically one-quarter to one-half inches. In the present invention, the distance G between fastener mechanism 213 and rigid and arcuate spine board 207 is zero to one-quarter inches.

Figure 3C:
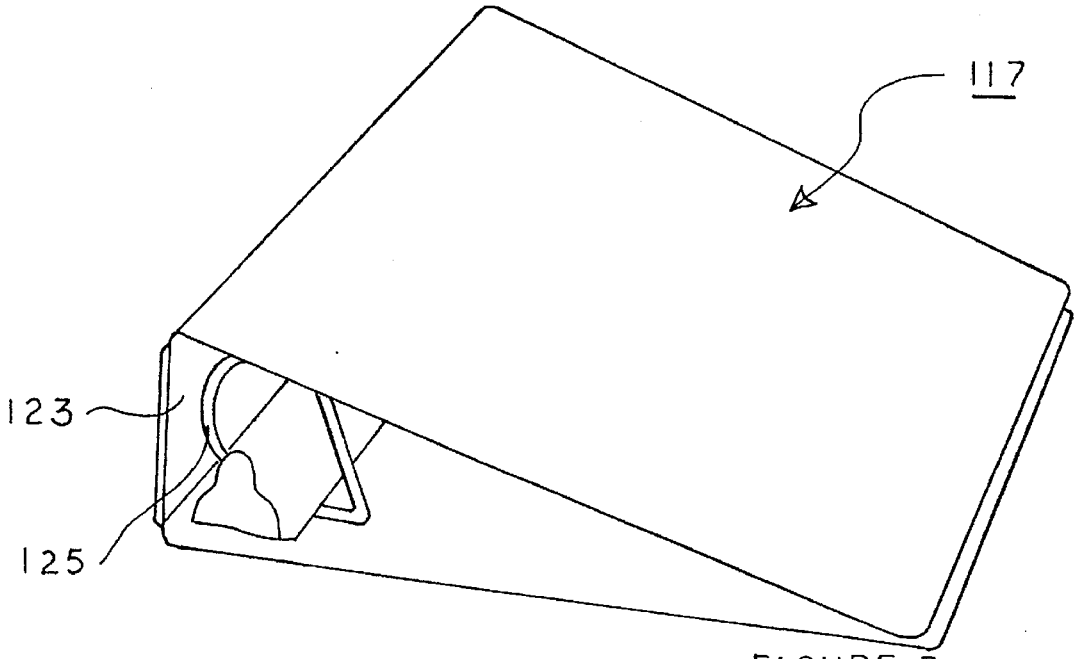
FIGURE 3c PRIOR ART
FIG. 3*c* and 3*d* provide perspective views comparison of a prior art D-ring binder with the improved D-ring binder of the present invention, each in a closed condition.
Figure 3D:
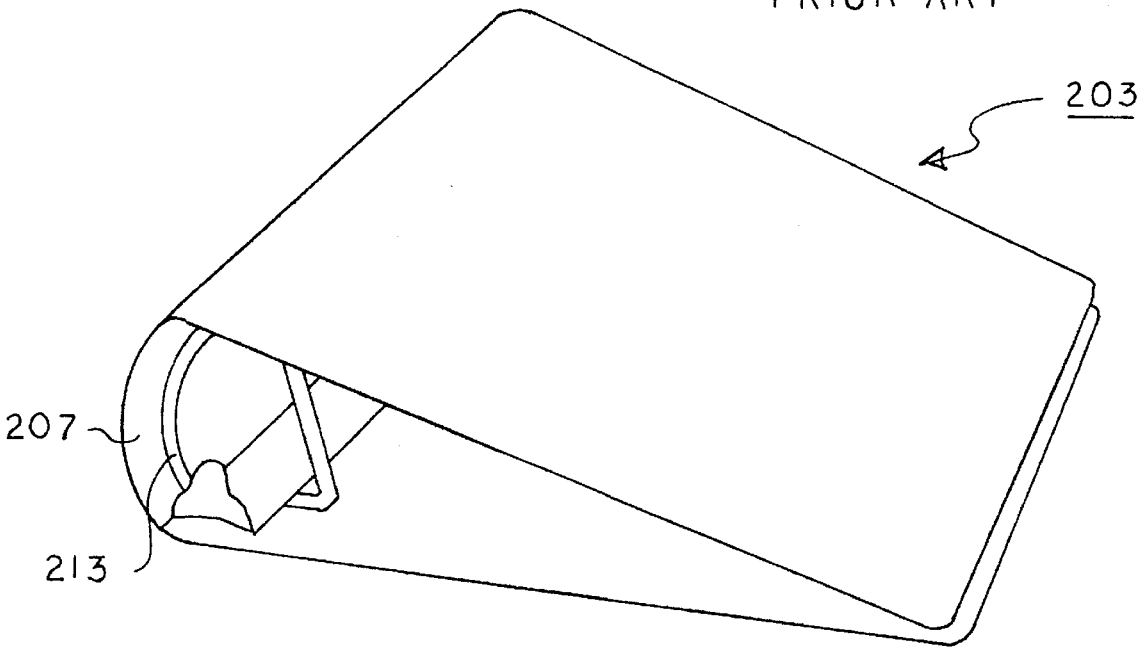
Figure 3E:
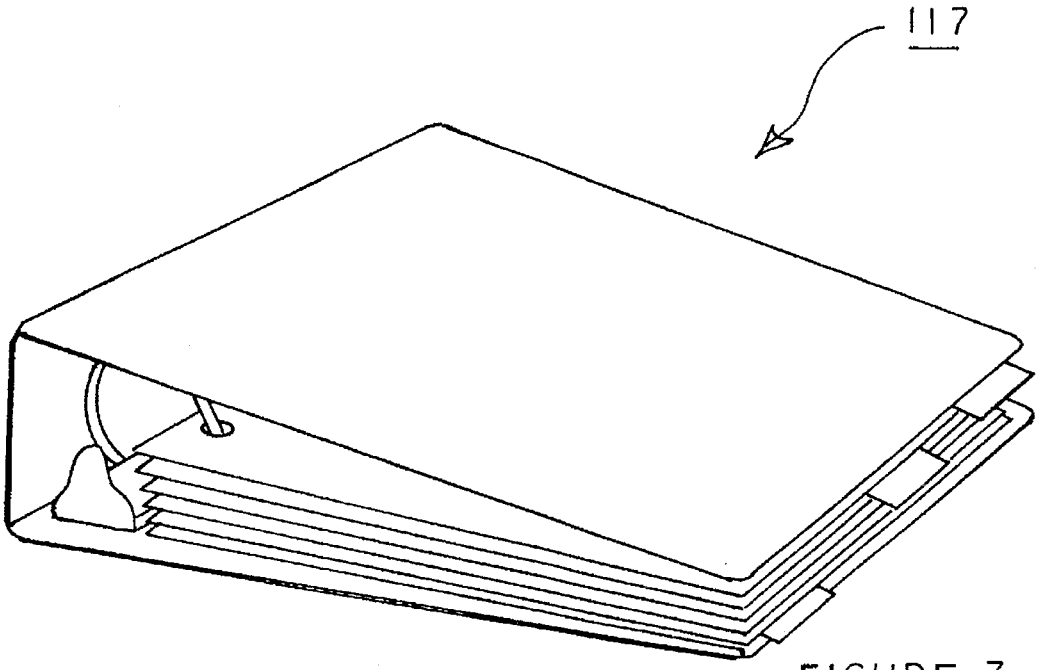
FIGURE 3e PRIOR ART
FIG. 3*g* provides a side-by-side perspective view comparison of a prior art D-ring binder and an improved D-ring binder of the present invention, which graphically depicts the extension of tabbed office products beyond the covers in a prior art D-ring binder.
FIG. 3*h* provides a side-by-side comparison of a prior art D-ring binder and a plurality of improved D-ring binders of the present invention to show the one advantage of the present invention in mass document archiving.
FIG. 3*i* provides an end view comparison of a prior art D-ring binder and an improved D-ring binder of the present invention.
Figure 3F:
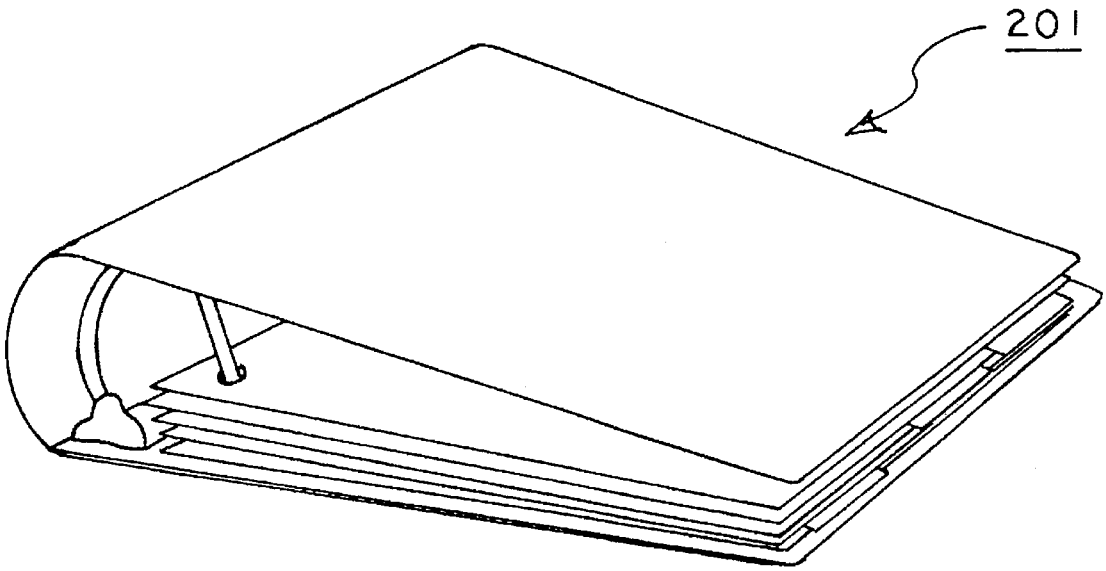
Figure 3G:
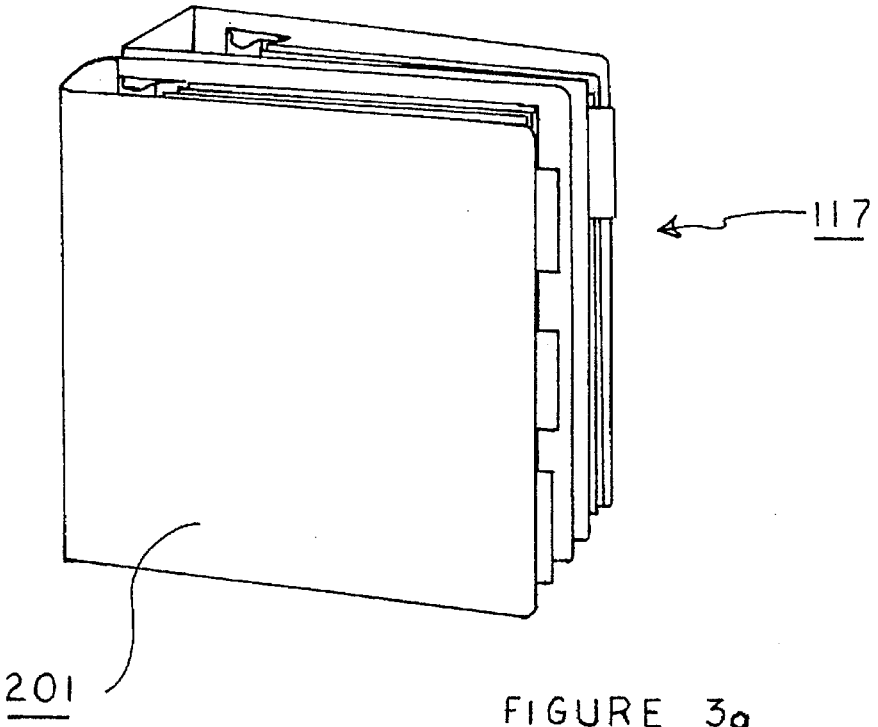
FIGURE 3g PRIOR ART
Figure 3H:
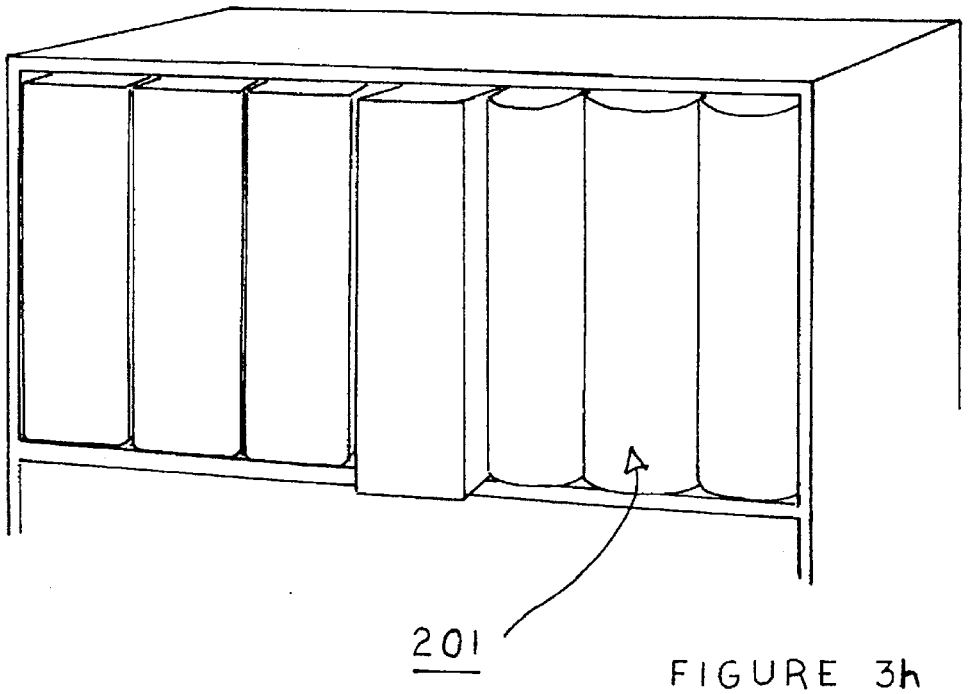
FIGURE 3h PRIOR ART
Figure 3I:
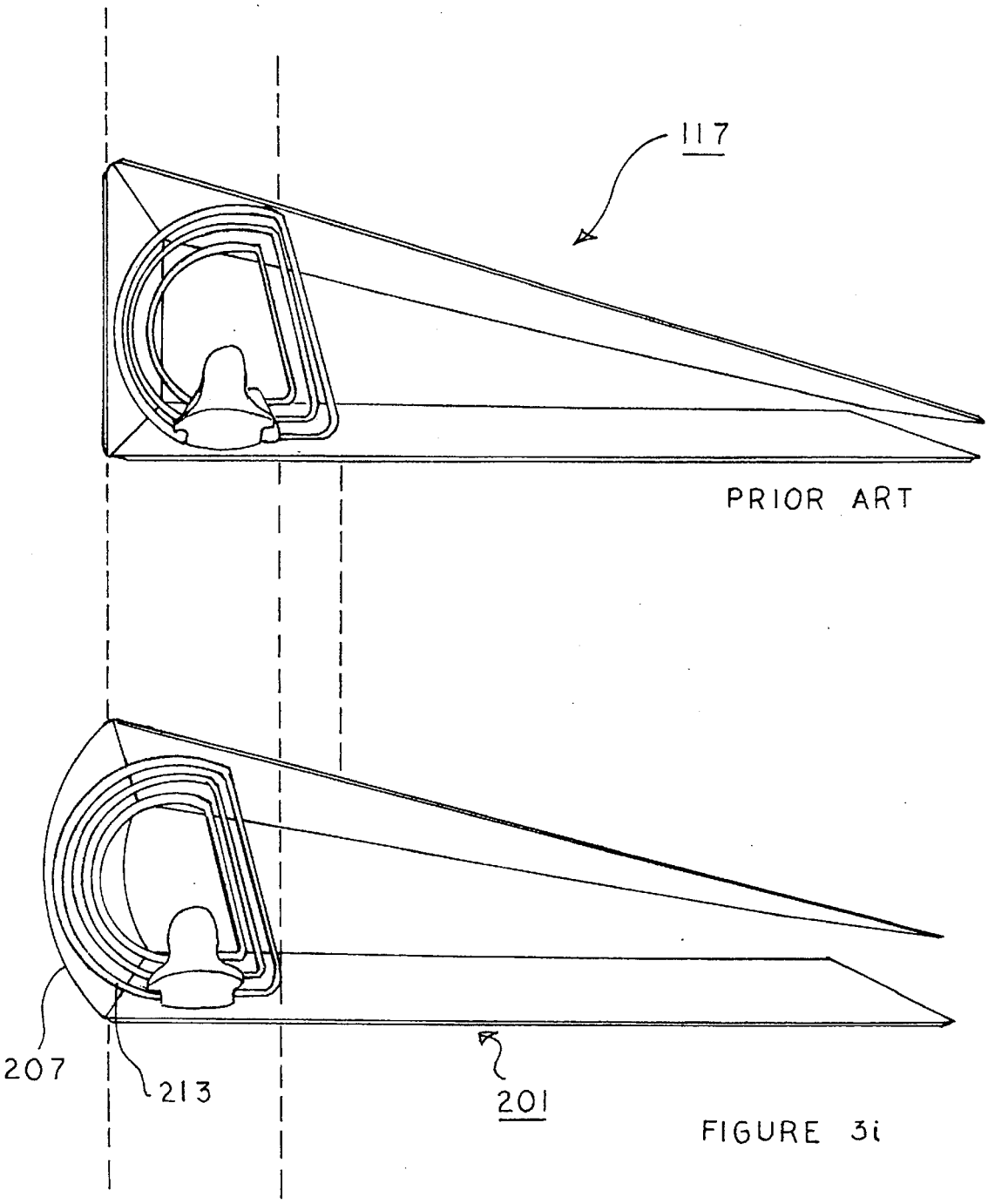

As is shown in FIGS. 3*c* and 3*d*, one disadvantage in the prior art binder 117 is that fastener mechanism 125 directly contacts spine 123. In larger capacity binders, such as a three inch capacity binder, this prevents the complete closure of binder 117, which is depicted in FIG. 3*b*. In contrast, in the present invention, since binder 203 includes fastener mechanism 213 which is nested within the convex side of rigid and arcuate spine board 207, large capacity binders are capable of being fully closed. Of course, as is depicted in FIGS. 3*e* and 3*f*, a conventional prior art binder 117 is not sufficient to fully protect tab portions which extend beyond the front and back covers. In contrast, in the present invention, binder 201 is capable of fully enclosing tabbed document archiving office products within the front and back covers of binder 201. As a consequence, as is shown in FIGS. 3*g* and 3*h*, utilization of the present invention preserves and protects the tab portions of the tabbed document archiving office products during ordinary use, and facilitates utilization of standard size storage shelves for holding a plurality of binders. As is shown in FIG. 3*i*, binding mechanism 213 is nested within the convex side of rigid and arcuate spine board 207. Note that the arcuate portion of the ring members has a curvature which generally corresponds to that of the rigid and arcuate spine board 207.

Figure 4A:
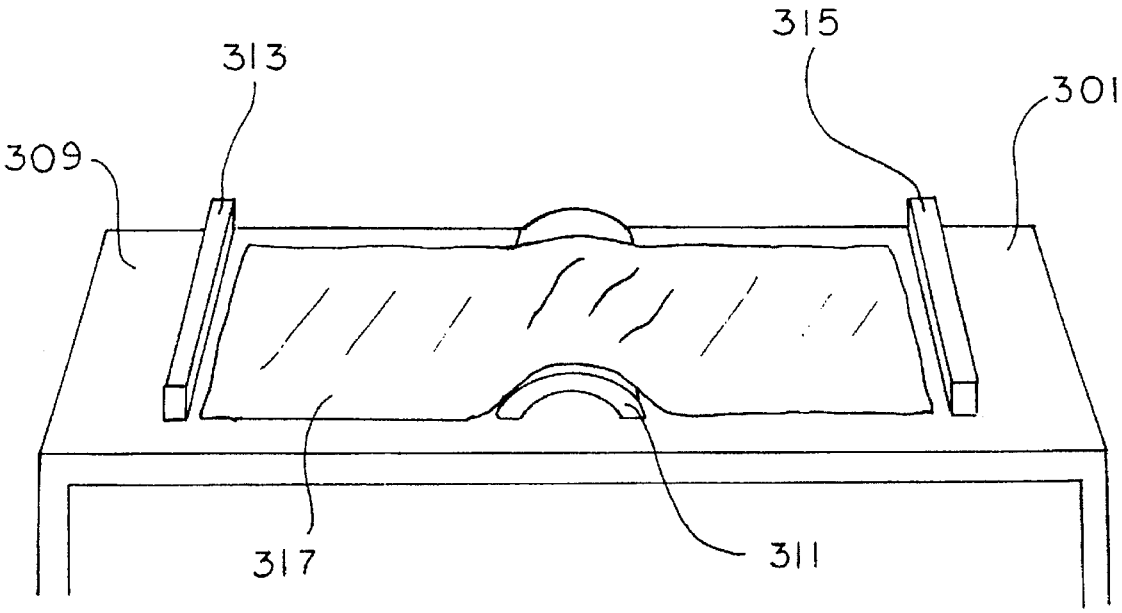
FIGS. 4*a* through 4*h* provide a pictorial representation of the preferred method of manufacturing a D-ring binder in accordance with the present invention, as well as the preferred apparatus utilized during manufacturing operations.
Figure 4B:
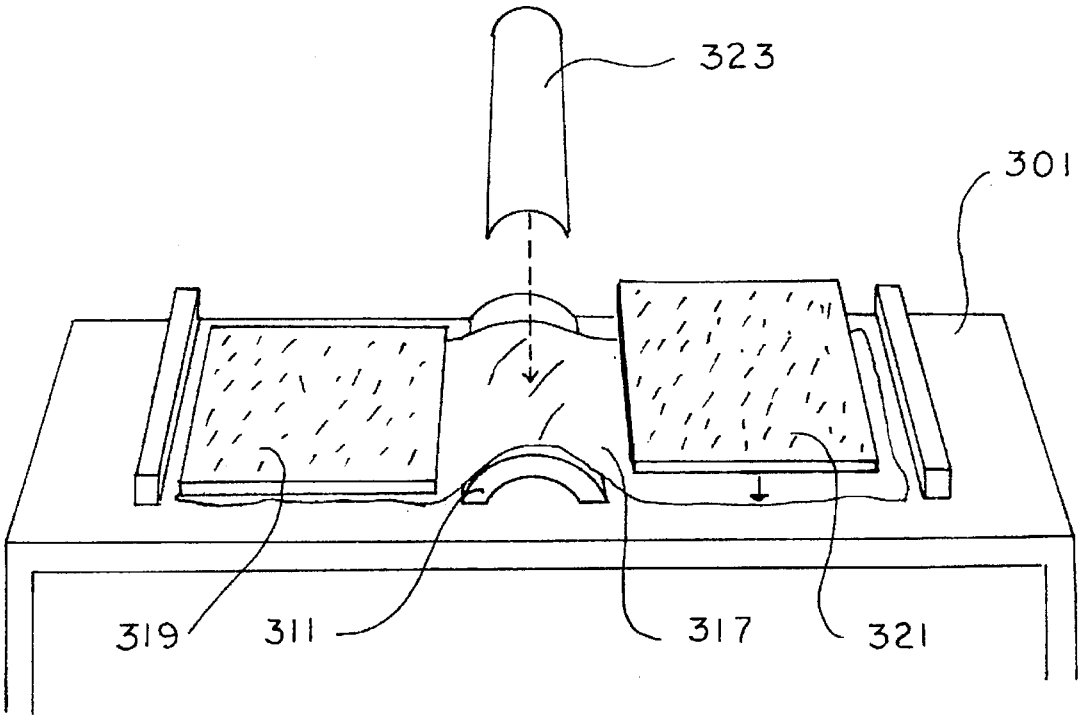
Figure 4C:
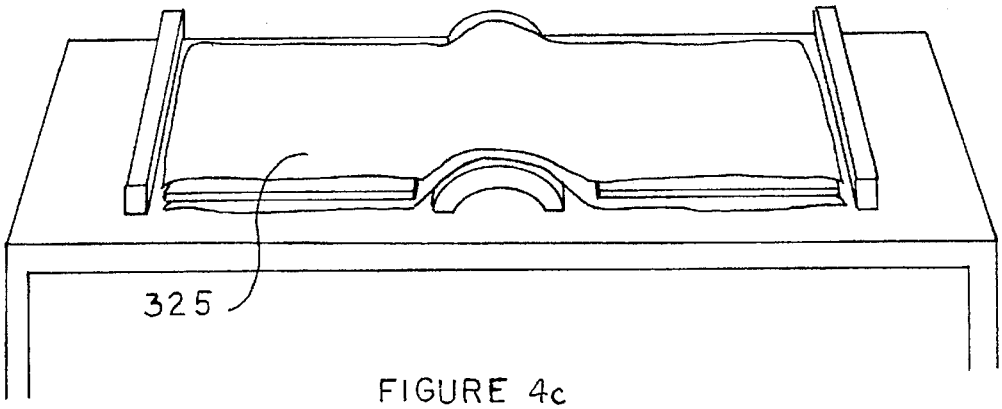
Figure 4E:
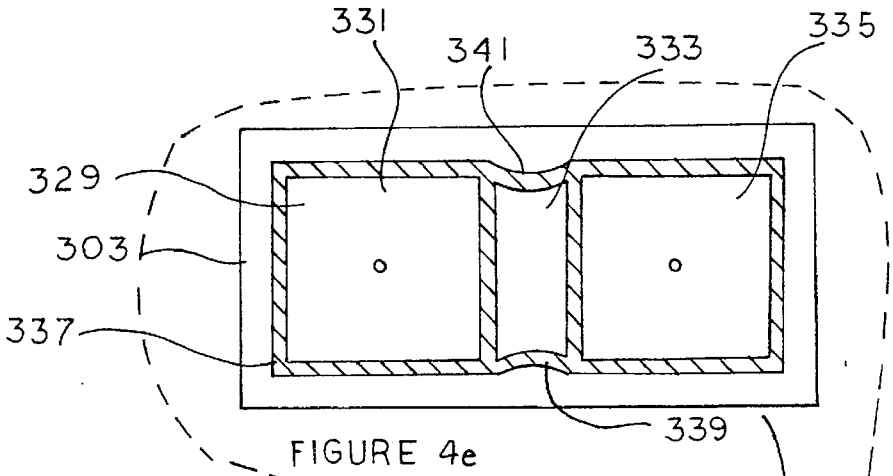
Figure 4D:
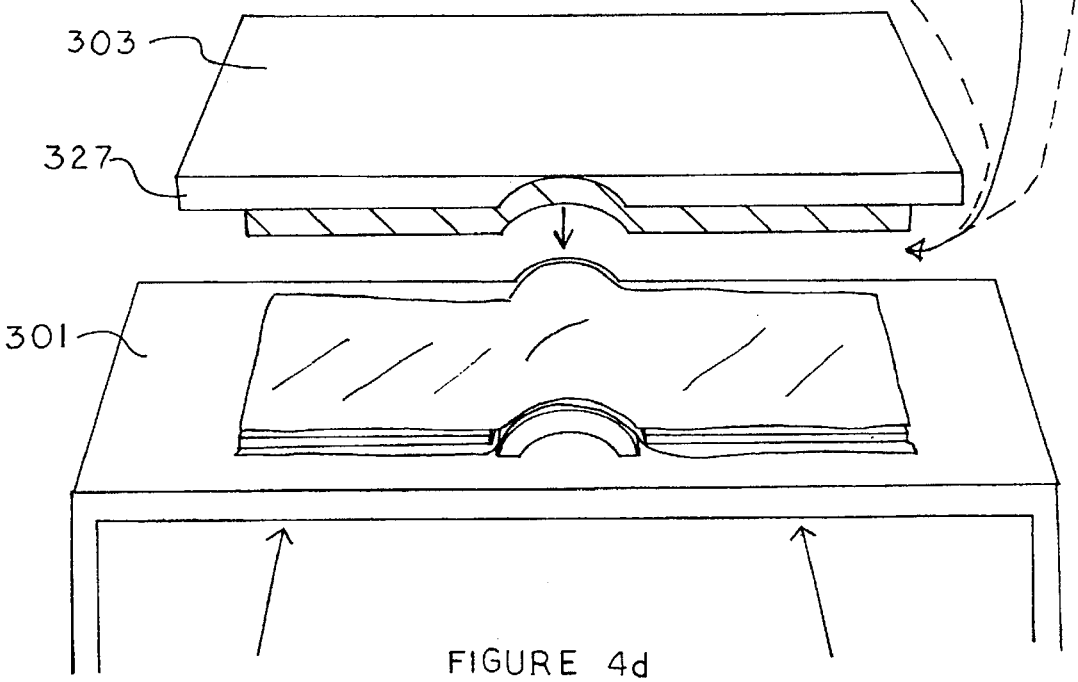
Figure 4F:
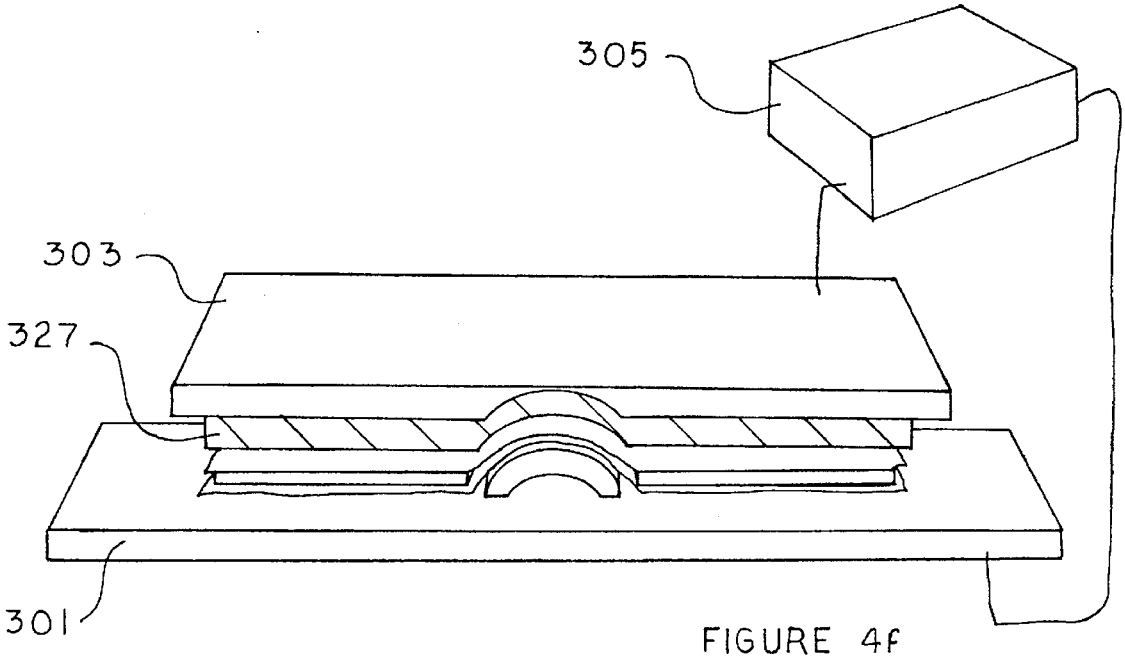
Figure 4G:
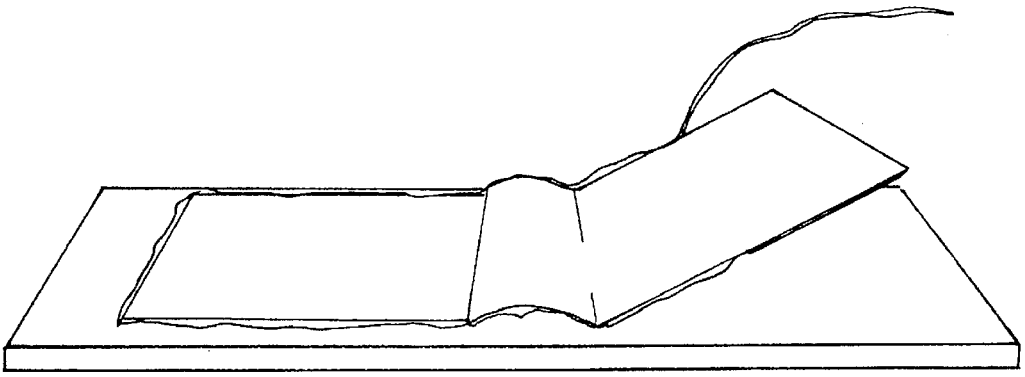

FIGS. 4*a* through 4*h* graphically depict both the method of manufacturing loose leaf binders in accordance with the present invention, and an apparatus which is utilized in the assembly-line manufacturing operations for loose leaf binders, also in accordance with the present invention. In the preferred embodiment of the present invention, set-up plate 301, press plate 303, source of bonding energy 305, and means 307 for preferentially directing bonding energy between the set-up plate 301 and the press plate 303 are utilized in combination to manufacture binders in accordance with the present invention. FIGS. 4*a* and 4*b* show the set-up of operations upon set-up plate 301. FIGS. 4*c* the utilization of press plate 103. FIGS. 4*f* and 4*g* show the utilization of the source of bonding energy 305 in combination with the means 307 for preferentially directing the bonding energy. In FIGS. 4*a* through 4*g*, the broad method of manufacturing loose leaf binders in accordance with the present invention is set forth in seven steps.

With reference first to FIG. 4*a* and 4*b*, set-up plate 301 includes a rigid planar surface 309, and a concave member 311 placed in a central position thereon. Both rigid and planar surface 309 and concave member 311 are conductive of high frequency electromagnetic waves, and thus may be formed from steel or brass or other conductive or semi-conductive materials. Set-up plate 301 further includes orienting bars 313, 315 which facilitate assembly of the binder components. In the preferred embodiment of the present invention, concave member 311 may be removable from planar and rigid surface 309 to allow conventional binders to be manufactured with this press assembly.

The industry-standard sources of bonding energy require that a layer of dielectric material be positioned over the work surfaces of set-up plate 301. A sheet of flexible and bondable material 317 is positioned over the dielectric material. In the preferred embodiment of the present invention, flexible and bondable sheet 317 is composed of vinyl, although it is possible to utilize other comparable industry materials. Next, as is shown in step 2, of FIG. 4*b* a rigid and planar lid board is positioned to the left of the concave member 311 over flexible and bondable sheet 317. Then, rigid and planar lid board 321 is positioned to the right of concave member 311 on the substantially rigid and planar space, and directly over flexible and bondable sheet 317. In the preferred embodiment of the present invention, rigid and planar lid boards 319, 321 are conventional lid boards utilized for loose-leaf binders, which are composed of stiff paper or cardboard, and which are nonconductive of the energy provided by source of bonding energy 305.

Next, rigid and arcuate spine member 323 is positioned over flexible and bondable sheet 317 directly above concave member 311, with the convex side of rigid and arcuate spine member 323 engaging the concave surface. Preferably, the radius of curvature of the rigid and arcuate spine member 323 matches exactly the radius of curvature of concave member 311, to provide a close fit. In the preferred embodiment of the present invention, rigid and arcuate spine member 323 is formed from any material which (1) has a high strength, (2) has a high rigidity in order to maintain its curvature, and (3) which is non-conductive of the energy provided by source of bonding energy 305. In the preferred embodiment of the present invention, polyvinylchloride or polystyrene is utilized to manufacture rigid and arcuate spine member 323. Preferably, the radius of curvature of the rigid and arcuate spine member is in the range of one and one-quarter inches (1¼") to two and one-half (2½") inches, depending upon the paper capacity of the binder being manufactured, with the lower capacity binders having a lower radius of curvature and the higher capacity binders having a higher radius of curvature.

Turning now to FIG. 4*c* and FIG. 4*d* and 4*e*, flexible and bondable sheet 325 is positioned over lid board 319, lid board 321 and rigid and arcuate spine member 323. In the preferred embodiment of the present invention, flexible and bondable sheet 325 comprises a vinyl sheet, but in alternative embodiments other materials may be utilized.

FIG. 4*b* simultaneously shows a perspective and plan view of press plate 303. Press plate 303 includes a substantially planar and conductive work surface 327 which is suitable for conducting energy from source of bonding energy 305. It further includes a press plate which is adapted to conform exactly to the contours of the materials which have been set up upon set-up plate 301. Sealing die 329 is mounted to press plate 327 and includes regions which are conductive of the energy of source of bonding energy 305 and regions which are nonconductive of the energy of source of bonding energy 305. Planar panel 331 and planar panel 335 are adapted in size and shape to be identical to the size and shape of the lid boards 319, 321. Arcuate panel 333 is adapted in size and shape to conform exactly to the size and shape of rigid and arcuate spine member 323. Panels 331, 333, 335 are non-conductive of the energy of source of bonding energy 305. Conductive structure 337 surrounds panels 331, 333, 335 and is conductive of the energy of source of bonding energy 305. Conductive structure 337 serves as a means for preferentially directing bonding energy between press plate 303 and set-up plate 301. Bonding energy will flow only through conductive structure 337 into set-up plate 301.

Note that conductive structure 337 includes arcuate portions 339, 341 which are adapted to exactly conform to the radius of curvature of rigid and arcuate spine member 323 and concave member 311. In the preferred embodiment of the present invention, conductive structure 337 does not make contact with lid board 319, lid board 321, or rigid and arcuate spine member 323. Instead, conductive structure 337 contacts the flexible and bondable sheet 325 in regions which are peripheral to lid board 319, lid board 321 and rigid and arcuate spine member 323, causing flexible and bondable sheet 325 to bond to flexible and bondable sheet 317 in those regions surrounding lid board 319, lid board 321, and rigid and arcuate spine member 323. As is shown in FIG. 4*c*, 4*d*, and 4*e*, press plate 303 is brought into contact with set-up plate 301 in order to accomplish this bonding.

Figure 4H:
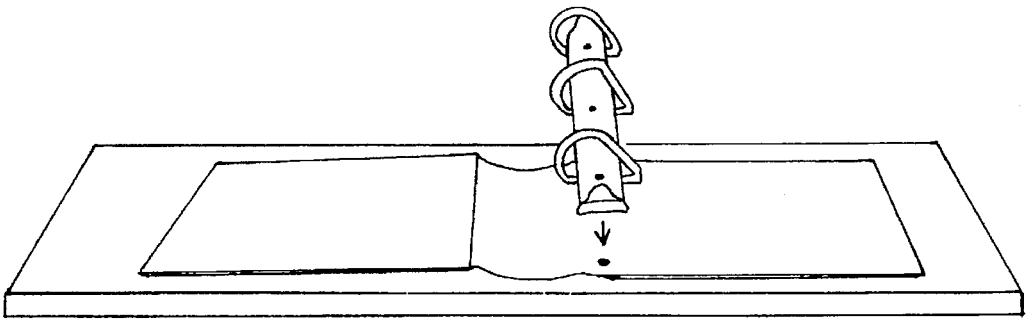

FIG. 4*f*, 4*g* and 4*h* depicts the remaining steps of this operation. As is shown, bonding energy is conducted through press plate 303, conductive structure 327 and set-up plate 301 in an electrical circuit established with source bonding energy 305. In the preferred embodiment of the present invention, the source of bonding energy 305 comprises a high frequency welding tool manufactured by Hall Dielectric Machinery Company, Inc. of Deer Park, N.J. It is a capacitive high frequency welding tool which is based upon the dielectric high frequency heating of thermoplastics, which is widely known and applied. A high frequency alternating electrical field is applied to the electrodes (in this case, conductive structure 327 and set-up plate 301), causing the movement of molecules in the vinyl sheets to be accelerated. The molecules which make up the vinyl sheets of the flexible and bondable sheets 317 and 325 are caused to align themselves many millions of times per second. This creates an internal friction which generates heat which bonds the sheets together. The apparatus utilized in the preferred embodiment of the present invention operates at a frequency of 27.12 megahertz. After the flexible and bondable sheets are bonded together, the excess material is removed as is shown in step 6, of FIG. 4*g* the cover structure is flipped over, and the fastener mechanism is riveted in place, as is shown in step 7 of FIG. 4*h*.

In one alternative embodiment, a binder may be constructed which has flexible front and back covers. This embodiment of the binder of the present invention would require the substitution of a flexible planar sheet or board in place of the rigid and planar front and back lid boards. It may be possible to form such boards from expanded or non-expanded vinyl, polyvinylchloride, or polypropylene. Alternatively, light papers or fabrics may be utilized to provide flexibility in the front and back covers. A binder with flexible front and back covers may also be constructed by utilizing thick layers of flexible and bondable sheets for the cover and liner sheets, and provide no insert between the cover and liner sheets. In this event, the cover and liner sheets will be bonded in their entirety in the regions which will form the front and back covers, but will bond peripherally about the rigid and arcuate spine board. This would require the utilization of a press plate which includes a conductive region which spans the entire surface area of the front and back covers to ensure bonding of the liner and cover sheets.

While the invention has been shown in only one of its forms, it is not thus limited but is susceptible to various changes and modifications without departing from the spirit thereof.

What is claimed is:

1. A binder for storing tabbed document archiving office products capable of non-destructive retention of standard-sized documents in industry standard storage shelves which have a standard width, comprising:

a rigid and planar front lid board;

a rigid and planar back lid board;

said rigid and planar front lid board and said rigid and planar back lid board having identical widths;

a rigid and arcuate spine board positioned intermediate said rigid and planar front lid board and said rigid and planar back lid board;

a flexible and bondable cover sheet;

a flexible and bondable liner sheet;

said flexible and bondable cover and liner sheets being bonded together at portions peripheral to (a) said rigid and planar front lid board, (b) said rigid and planar back lid board, and (c) said rigid and arcuate spine board;

said rigid and planar front lid board, said rigid and planar back lid board, and said rigid and arcuate spine board together having a width which does not exceed said standard width of said industry standard storage shelves when said binder is in a closed condition;

a fastener mechanism coupled to said rigid and planar back lid board adjacent said rigid arid arcuate spine board;

said fastener mechanism including:

(a) a plurality of separable ring members spaced apart;

(b) each of said plurality of separable ring members including an arcuate ring portion adjacent said rigid and arcuate spine board with a curvature generally corresponding to that of said rigid and arcuate spine board;

means for maintaining said tabbed document archiving office products entirely within said rigid and planar front lid board and said rigid and planar back lid board when said binder is in a closed condition, including:

means for at least partially housing said fastener within a curvature defined by said rigid and arcuate spine board when said binder is in a closed condition.

2. A binder according to claim 1, wherein said fastener mechanism comprises a D-ring fastener mechanism, which includes:

(a) a plurality of separable ring members spaced apart;

(b) each of said plurality of separate ring members including an arcuate ring portion and a slanted portion, with said arcuate ring portion positioned adjacent said rigid and arcuate spine board.

3. A binder according to claim 1, wherein said flexible and bondable cover and liner sheets comprises film vinyl sheets.

4. A binder according to claim 1, wherein said rigid and arcuate spine board is formed of either polyvinylchloride or polystyrene.

5. A binder according to claim 1, wherein said rigid and arcuate spine board has a radius of curvature which is proportional to binder capacity, with a small radius of curvature utilized for small capacity binders and a large radius of curvature utilized for large capacity binders.

6. A binder for storing tabbed document archivinq office products capable of non-destructive retention of standard-sized documents in industry standard storage shelves which have a standard width, comprising:

a rigid and planar front lid board having a width which is within a range of industry-standard widths;

a rigid and planar back lid board having a width which is identical to that of said rigid and planar front lid board;

a rigid and arcuate spine board, having a preselected radius of curvature, and being positioned intermediate said rigid and planar front lid board and said rigid and planar back lid board;

a flexible and bondable cover sheet;

a flexible and bondable liner sheet;

said flexible and bondable cover and liner sheets being bonded together at portions peripheral to (a) said rigid and planar front lid board, and (b) said rigid and planar back lid board, and (c) said rigid and arcuate spine board;

said rigid and planar front lid board, said rigid and planar back lid board, and said rigid and arcuate spine board together having a width which does not exceed said standard width of said industry standard storage shelves when said binder is in a closed condition;

a fastener mechanism coupled to said rigid and planar back lid board adjacent a convex side of said rigid and arcuate spine board;

said binder being operable in a plurality of conditions, including:

(a) an open condition for receiving a plurality of documents and office products, including tabbed document archiving office products capable of non-destructive retention of standard-sized documents; and (b) a closed condition for storing said plurality of documents and office products;

means for maintaining said tabbed document archiving office products entirely within said rigid and planar front lid board and said rigid and planar back lid board when said binder is in a closed condition, including:

means for at least partially housing said fastener within a curvature defined by said rigid and arcuate spine board when said binder is in a closed condition.

7. A binder according to claim 6, wherein said fastener mechanism comprises a D-ring fastener mechanism, which includes:

(a) a plurality of separable ring members spaced apart;

(b) each of said plurality of ring members including an arcuate ring portion and a slanted portion;

wherein, during said closed condition, said arcuate ring portion is nested within a convex side of said rigid and arcuate spine board.

8. A binder according to claim 6, wherein said flexible and bondable cover and liner sheets comprise vinyl sheets.

9. A binder according to claim 6, wherein said rigid and arcuate spine board has a preselected radius of curvature which is proportional to binder capacity.

10. A binder according to claim 6, wherein said fastener mechanism comprises a D-ring fastener mechanism, which includes:

(a) a plurality of separable ring members spaced apart;

(b) each of said plurality of ring members including an arcuate ring portion and a slanted portion;

wherein, during said closed condition, said arcuate ring portion is nested within a convex side of said rigid and arcuate spine board.

11. A binder for storing tabbed document archiving office products capable of non-destructive retention of standard-sized documents in industry standard storage shelves which have a standard width, comprising:

a flexible and planar front lid board;

a flexible and planar back lid board;

said flexible and planar front and back lid boards having identical widths;

a rigid and arouate spine board positioned intermediate said flexible and planar front lid board and said flexible and planar back lid board;

said rigid and planar front lid board, said rigid and planar back lid board, and said rigid and arcuate spine board together having a width which does not exceed said standard width of said industry standard storage shelves when said binder is in a closed condition;

a fastener mechanism coupled to said flexible and planar back lid board adjacent said rigid and arcuate spine board;

said fastener mechanism including:

(a) a plurality of separable ring members spaced apart;

(b) each of said plurality of separable ring members including an arcuate ring portion adjacent said rigid and arcuate spine board with a curvature generally corresponding to that of said rigid and arcuate spine board;

means for maintaining said tabbed document archiving office products entirely within said rigid and planar front lid board and said rigid and planar back lid board when said binder is in a closed condition, including:

means for at least partially housing said fastener within a curvature defined by said rigid and arcuate spine board when said binder is in a closed condition.

12. A binder according to claim 11, wherein said fastener mechanism comprises a D-ring fastener mechanism, which includes:

(a) a plurality of separable ring members spaced apart;

(b) each of said plurality of separate ring members including an arcuate ring portion and a slanted portion, with said arcuate ring portion positioned adjacent said rigid and arcuate spine board.

13. A binder for storing tabbed document archiving office products capable of non-destructive retention of standard-sized documents in industry standard storage shelves have a standard width, comprising:

a flexible and planar front lid board having a width which is within a range of industry-standard widths;

a flexible and planar back lid board having a width which is identical to that of said flexible and planar front lid board;

a rigid and arcuate spine board, having a preselected radius of curvature, and being positioned intermediate said flexible and planar front lid board and said flexible planar back lid board;

said rigid and planar front lid board, said rigid and planar back lid board, and said rigid and arcuate spine board together having a width which does not exceed said standard width of said industry standard storage shelves when said binder is in a closed condition;

a fastener mechanism coupled to said flexible and planar back lid board adjacent a convex side of said rigid and arcuate spine board;

said binder being operable in a plurality of conditions, including:

(a) an open condition for receiving a plurality of documents and office products, including tabbed document archiving office products capable of non-destructive retention of standard-sized documents; and (b) a closed condition for storing said plurality of documents and office products;

means for maintaining said tabbed document archiving office products entirely within said rigid and planar front lid board and said rigid and planar back lid board when said binder is in a closed condition, including:

means for at least partially housing said fastener within a curvature defined by said rigid and arcuate spine board when said binder is in a closed condition.

* * * * *